US011885548B2

(12) United States Patent
Imanishi et al.

(10) Patent No.: US 11,885,548 B2
(45) Date of Patent: Jan. 30, 2024

(54) REFRIGERATION CYCLE APPARATUS THAT INJECTS REFRIGERANT INTO COMPRESSOR DURING LOW LOAD OPERATION

(71) Applicant: MITSUBISHI ELECTRIC CORPORATION, Tokyo (JP)

(72) Inventors: Toshiki Imanishi, Tokyo (JP); Kohei Tatsuwaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 280 days.

(21) Appl. No.: 17/288,093

(22) PCT Filed: Jan. 7, 2019

(86) PCT No.: PCT/JP2019/000058
§ 371 (c)(1),
(2) Date: Apr. 23, 2021

(87) PCT Pub. No.: WO2020/144728
PCT Pub. Date: Jul. 16, 2020

(65) Prior Publication Data

US 2021/0372680 A1 Dec. 2, 2021

(51) Int. Cl.
*F25B 41/42* (2021.01)
*F25B 41/31* (2021.01)
(Continued)

(52) U.S. Cl.
CPC ..... *F25B 49/027* (2013.01); *F25B 1/04* (2013.01); *F25B 41/20* (2021.01); *F25B 41/31* (2021.01);
(Continued)

(58) Field of Classification Search
None
See application file for complete search history.

(56) References Cited

U.S. PATENT DOCUMENTS 4,503,685 A * 3/1985 DiCarlo ..... G05D 23/126 62/193
2010/0300659 A1 12/2010 Stover et al.
(Continued)

FOREIGN PATENT DOCUMENTS

JP 03067958 A 3/1991
JP H06-229634 A 8/1994
(Continued)

OTHER PUBLICATIONS

International Search Report dated Mar. 12, 2019, issued in corresponding International Application PCT/JP2019/000058 (and English translation).
(Continued)

*Primary Examiner* — Jerry-Daryl Fletcher
*Assistant Examiner* — Daniel C Comings
(74) *Attorney, Agent, or Firm* — POSZ LAW GROUP, PLC

(57) ABSTRACT

A refrigeration cycle apparatus includes: a refrigeration cycle circuit in which a compressor, a condenser, a first expansion valve, and an evaporator are connected by refrigerant pipes; an injection pipe having a refrigerant inflow side end and a refrigerant outflow side end, the refrigerant inflow side being connected between the condenser and the first expansion valve, the refrigerant outflow side end being connected to a suction side of the compressor; a second expansion valve provided at the injection pipe; and a controller that controls a rotation speed of the compressor and an opening degree of the second expansion valve. In the case of reducing a heat-exchange capability of the evaporator when the rotation speed of the compressor is a specified rotation speed, the controller performs a low load operation during which refrigeration is caused to flow through the injection pipe.

8 Claims, 8 Drawing Sheets

(51) Int. Cl.
*F25B 49/02* (2006.01)
*F25B 41/20* (2021.01)
*F25B 1/04* (2006.01)

(52) U.S. Cl.
CPC ..... *F25B 41/42* (2021.01); *F25B 49/022* (2013.01); *F25B 2400/0409* (2013.01); *F25B 2400/13* (2013.01); *F25B 2500/16* (2013.01); *F25B 2600/025* (2013.01); *F25B 2600/0253* (2013.01); *F25B 2600/2509* (2013.01); *F25B 2600/2513* (2013.01); *F25B 2700/171* (2013.01); *F25B 2700/21163* (2013.01)

(56) References Cited

U.S. PATENT DOCUMENTS

| | | | | |
|---|---|---|---|---|
| 2014/0216102 | A1 | 8/2014 | Ignatiev et al. | |
| 2016/0082810 | A1 * | 3/2016 | Suzuki | F25B 41/24 62/325 |
| 2017/0335847 | A1 | 11/2017 | Kawamura et al. | |
| 2019/0234643 | A1 | 8/2019 | Yamada et al. | |
| 2020/0284476 | A1 | 9/2020 | Nishio et al. | |

FOREIGN PATENT DOCUMENTS

| | | | | |
|---|---|---|---|---|
| JP | 2016-011768 | A | 1/2016 | |
| JP | 2018-054235 | A | 4/2018 | |
| WO | WO-2005045330 | A2 * | 5/2005 | F25B 49/005 |
| WO | 2016/079858 | A1 | 5/2016 | |
| WO | 2018/198164 | A1 | 11/2018 | |

OTHER PUBLICATIONS

Office Action dated Oct. 5, 2021 issued in corresponding JP patent application No. 2020-565041 and English translation).
Extended European Search Report dated Nov. 29, 2021, issued in corresponding European Patent Application No. 19908802.2.

* cited by examiner

REFRIGERATION CYCLE APPARATUS THAT INJECTS REFRIGERANT INTO COMPRESSOR DURING LOW LOAD OPERATION

CROSS REFERENCE TO RELATED APPLICATION

This application is a U.S. National Stage Application of International Application No. PCT/JP2019/000058, filed on Jan. 7, 2019, the contents of which are incorporated herein by reference.

TECHNICAL FIELD

The present disclosure relates to a refrigeration cycle apparatus that reduces repetition of stopping and starting of a compressor during an operation at a low load.

BACKGROUND ART

The capacity of a refrigeration cycle apparatus is adjusted by changing the rotation speed of a compressor based on a thermal load that is processed by the refrigeration cycle apparatus. Therefore, as the thermal load to be processed decreases, the rotation speed of the compressor is reduced. It should be noted that that refrigerating machine oil is supplied to a slide portion of the compressor, using rotation of a driving shaft of the compressor. Therefore, if the rotation speed of the compressor is excessively reduced, refrigerating machine oil cannot be sufficiently supplied the slide portion, and as a result, the reliability of the compressor is reduced. Thus, in the compressor, a lower limit rotation speed is specified in order to ensure reliability of the compressor.

When a thermal load that is processed by the refrigeration cycle apparatus is low, the capacity of the refrigeration cycle apparatus may be high for the thermal load even while the compressor is being driven at the lower limit rotation speed. In such a case, the refrigeration cycle apparatus performs an intermittent operation in which stopping and starting of the compressor are repeated, to thereby adjust the capacity of the refrigeration cycle apparatus for the thermal load to be processed. It should be noted that when the refrigeration cycle apparatus performs the intermittent operation, it is necessary to temporarily equalize the pressures of high-pressure refrigerant and low-pressure refrigerant in consideration of, for example, the durability of components included in the refrigeration cycle apparatus, as a result of which heat is transferred between the refrigerants. Therefore, when the refrigeration cycle apparatus performs the intermittent operation, the operation efficiency of the refrigeration cycle apparatus is reduced.

In particular, in an air-conditioning apparatus of recent times that is an example of a refrigeration cycle apparatus, there is a case where stopping and starting of a compressor are frequently repeated. Specifically, in recent years, heat insulation capacities of building have been improved, and as a result, thermal loads in buildings tend to be lower. It should be noted that in an air-conditioning apparatus, the thermal load is a heating load or a cooling load. In the air-conditioning apparatus, the heating capacity is set in consideration of the height of winter, and the cooling capacity is set in consideration of the height of summer. Therefore, in the case where a compressor is normally driven when being in a low load state, since the capacity at an operation start time is large, stopping and starting of the compressor are frequently repeated. Consequently, the operation efficiency of the air-conditioning apparatus is greatly reduced.

In view of the above, a proposed air-conditioning apparatus is designed to reduce repetition of stopping and starting of a compressor (see Patent Literature 1). In the air-conditioning apparatus described in Patent Literature 1, when the thermal load is low, a low-load start control is performed. During the low-load start control, the compressor is driven at a rotation speed that is lower than a rotation speed at which the compressor is driven under normal control. In such a manner, the air-conditioning apparatus of Patent Literature 1 reduces repetition of stopping and starting of the compressor by controlling the rotation speed at which the compressor is started.

CITATION LIST

Patent Literature

Patent Literature 1: Japanese Unexamined Patent Application Publication No. 2016-11768

SUMMARY OF INVENTION

Technical Problem

In the air-conditioning apparatus of Patent Literature 1, in the case where the compressor is being driven at an unchanged rotation speed, the capacity of the air-conditioning apparatus at the time of performing the low-load start control is the same as that of the air-conditioning apparatus at the time of performing the normal control. Therefore, in the case where the capacity is large for a thermal load even when the compressor is being driven at the lower limit rotation speed, the air-conditioning apparatus of Patent Literature 1 repeats stopping and starting of the compressor after all, and cannot sufficiently reduce repetition of stopping and starting of the compressor.

The present disclosure is made to solve the above problem, and relates to a refrigeration cycle apparatus that can further reduce repetition of stopping and starting of a compressor than existing refrigeration cycle apparatuses.

Solution to Problem

A refrigeration cycle apparatus according to an embodiment of the present disclosure includes: a refrigeration cycle circuit in which a compressor, a condenser, a first expansion valve, and an evaporator are connected by refrigerant pipes; an injection pipe having a refrigerant inflow side end and a refrigerant outflow side end, the refrigerant inflow side being connected between the condenser and the first expansion valve, the refrigerant outflow side end being connected to a suction side of the compressor; a second expansion valve provided at the injection pipe; and a controller that controls a rotation speed of the compressor and an opening degree of the second expansion valve. In the case of reducing a heat-exchange capability of the evaporator when the rotation speed of the compressor is a specified rotation speed, the controller performs a low load operation during which refrigeration is caused to flow through the injection pipe.

Advantageous Effects of Invention

In the refrigeration cycle apparatus according to the embodiment, during the low load operation, refrigerant is made to flow through the injection pipe, thereby reducing the flow rate of refrigerant that flows in the evaporator, and thus reducing the heat-exchange capability of the evaporator. Therefore, in the refrigeration cycle apparatus according to the embodiment, during the low load operation, it is possible to reduce the capacity of the refrigeration cycle apparatus without changing the rotation speed of the compressor. Accordingly, in the refrigeration cycle apparatus according to the embodiment, in the case where the capacity is large for a thermal load even when the compressor is being driven at the lower limit rotation speed, the capacity can be reducing by causing refrigerant to flow through the injection pipe. Thus, when the load is low, the refrigeration cycle apparatus according to the embodiment can further reduce repetition of stopping and starting of the compressor than existing refrigeration cycle apparatuses.

DESCRIPTION OF EMBODIMENTS

In the following, examples of refrigeration cycle apparatuses according to embodiments of the present disclosure are described with reference to, for example, the drawings. It should be noted that each of configurations as described below regarding the embodiments is merely an example. Each of the refrigeration cycle apparatuses according to the embodiments of the present disclosure is not limited to any of the configurations as described below regarding the embodiments. Furthermore, in each of the drawings, the relationship in size between components may be different from that between actual components according to the present disclosure. In addition, the following description is made by referring to by way of example the case where the refrigeration cycle apparatus according to each of the embodiments of the present disclosure is used as an air-conditioning apparatus.

Embodiment 1

[Configuration of Refrigeration Cycle Apparatus 200]

Figure 1:
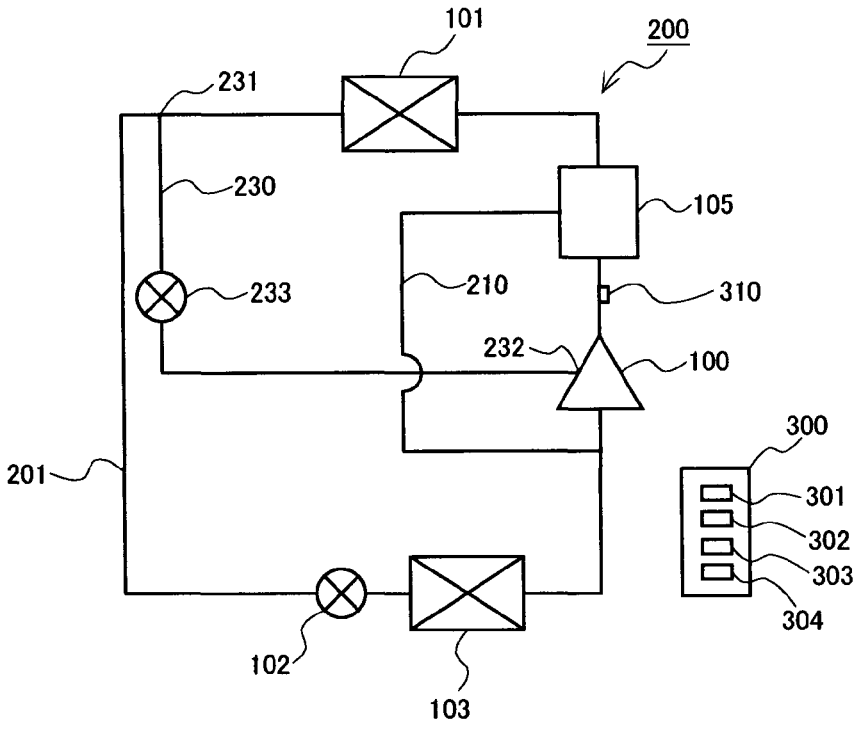
FIG. 1 is a refrigerant circuit diagram of a refrigeration cycle apparatus according to Embodiment 1 of the present disclosure.

FIG. 1 is a refrigerant circuit diagram of a refrigeration cycle apparatus according to Embodiment 1 of the present disclosure.

The refrigeration cycle apparatus 200 includes a refrigeration cycle circuit 201 in which a compressor 100, a condenser 101, a first expansion valve 102, and an evaporator 103 are connected by refrigerant pipes.

The compressor 100 sucks low-pressure gas refrigerant, compresses the low-pressure gas refrigerant into high-temperature and high-pressure gas refrigerant, and discharges the high-temperature and high-pressure gas refrigerant. The condenser 101 has a refrigerant inflow portion that is connected to a discharge portion of the compressor 100 by a refrigerant pipe, and a refrigerant outflow portion that is connected to a refrigerant inflow portion of the first expansion valve 102 by a refrigerant pipe. The condenser 101 condenses, into high-pressure liquid refrigerant, the high-temperature and high-pressure gas refrigerant discharged from the compressor 100. In the condenser 101, the refrigerant outflow portion is located below the refrigerant inflow portion, whereby the condensed liquid refrigerant can efficiently pass through the condenser 101. The condenser 101 is, for example, a fin-and-tube heat exchanger that includes a plurality of heat transfer pipes through which refrigerant flows and fins through which the plurality of heat transfer pipes are extended. It should be noted that the configuration of the condenser 101 is not limited to that of the fin-and-tube heat exchanger. The condenser 101 may be a corrugated fin type heat exchanger that includes a plurality of heat transfer pipes through which refrigerant flows and corrugated fins that joins the plurality of heat transfer pipes together.

The first expansion valve 102 has the refrigerant inflow portion that is connected to the refrigerant outflow portion of the condenser 101 by a refrigerant pipe, and has a refrigerant outflow portion that is connected to a refrigerant inflow portion of the evaporator 103 by a refrigerant pipe. The first expansion valve 102 causes the high-pressure liquid refrigerant that has flowed out of the condenser 101 to be expanded to change into a low-temperature and low-pressure two-phase gas-liquid refrigerant. The first expansion valve 102 is, for example, an electronic expansion valve whose opening degree can be adjusted. It should be noted that the configuration of the first expansion valve 102 is not limited to that of the electronic expansion valve. The first expansion valve 102 may be, for example, a thermal expansion valve whose opening degree can be adjusted or a capillary tube whose opening degree cannot be adjusted. The evaporator 103 has the refrigerant inflow portion that is connected to the refrigerant outflow portion of the first expansion valve 102 by a refrigerant pipe, and has a refrigerant outflow portion that is connected to a suction portion of the compressor 100 by a refrigerant pipe. The evaporator 103 evaporates the low-temperature and low-pressure two-phase gas-liquid refrigerant that has flowed out of the first expansion valve 102 to change the low-temperature and low-pressure two-phase gas-liquid refrigerant into a low-pressure gas refrigerant. The configuration of the evaporator 103, as well as that of the condenser 101, is not limited to a specific one. In Embodiment 1, the evaporator 103 is a fin-and-tube heat exchanger.

Furthermore, the refrigeration cycle apparatus 200 according to Embodiment 1 includes an injection pipe 230 and a second expansion valve 233 provided at the injection pipe 230. The injection pipe 230 has a refrigerant inflow side end 231 connected between the condenser 101 and the first expansion valve 102. The injection pipe 230 has a refrigerant outflow side end 232 connected to the suction side of the compressor 100. It should be noted that the suction side of the compressor 100 is located between the refrigerant outflow portion of the evaporator 103 and a refrigerant suction port of a compression mechanism unit of the compressor 100 that will be described later. The second expansion valve 233 causes refrigerant that flows through the injection pipe 230 to be expanded. The configuration of the second expansion valve 233, as well as that of the first expansion valve 102, is not limited to a specific one. To be more specific, when the second expansion valve 233 is in the opened state, part of the high-pressure liquid refrigerant that has flowed out of the condenser 101 flows into the injection pipe 230, and is expanded at the second expansion valve 233. Then, the expanded refrigerant flows from the injection pipe 230 to the suction side of the compressor 100.

The refrigeration cycle apparatus 200 according to Embodiment 1 further includes an oil separator 105 and an oil return pipe 210. The oil separator 105 is provided between the compressor 100 and the condenser 101. As described below, the compressor 100 stores refrigerating machine oil that lubricates a slide portion of the compressor 100. This refrigerating machine oil is partially discharged along with refrigerant from the compressor 100. The oil separator 105 separates the refrigerating machine oil from the refrigerant discharged from the compressor 100. One end of the oil return pipe 210 is connected to the oil separator 105, and the other end of the oil return pipe 210 is connected to the suction side of the compressor 100. That is, the oil return pipe 210 returns the oil separated from the refrigerant by the oil separator 105 to the suction side of the compressor 100.

The refrigeration cycle apparatus 200 according to Embodiment 1 further includes various sensors and a controller 300 that controls components included in the refrigeration cycle apparatus 200 based on, for example, detection values obtained by detection performed by the sensors. For example, the refrigeration cycle apparatus 200 includes a temperature sensor 310 that is provided at a refrigerant pipe connecting the compressor 100 and the condenser 101, and that detects the temperature of the refrigerant pipe.

The controller 300 is dedicated hardware or a central processing unit (CPU) that executes a program stored in a memory. It should be noted that the CPU is also referred to as "central processing unit", "processing unit", "arithmetic unit", "microprocessor", "microcomputer", or "processor".

In the case where the controller 300 is dedicated hardware, the controller 300 corresponds to, for example, a single circuit, a multiple circuit, an application specific integrated circuit (ASIC), a field-programmable gate array (FPGA), or a combination thereof. The functions of function parts that are implemented by the controller 300 may be implemented by respective hardware, or may be implemented by single hardware.

In the case where the controller 300 is a CPU, the functions that are implemented by the controller 300 are implemented by software, firmware, or a combination of software and firmware. The software and the firmware are each described as a program and stored in a memory. The CPU reads out and executes the program stored in the memory, thereby implementing the functions. It should be noted that the memory is a nonvolatile or volatile semiconductor memory, such as a RAM, a ROM, a flash memory, an EPROM, or an EEPROM.

Alternatively, some of the functions of the controller 300 may be implemented by dedicated hardware, and others of the functions of the controller 300 may be implemented by software or firmware.

The controller 300 according to Embodiment 1 includes a reception unit 301, a thermal-load acquisition unit 302, a control unit 303, and a storage unit 304 as function parts. The reception unit 301 is a function part that receives detection values obtained by the various sensors that are included in the refrigeration cycle apparatus 200. The reception unit 301 receives, for example, data on a temperature detected by the temperature sensor 310. The thermal-load acquisition unit 302 is a function part that, for example, calculates a thermal load based on, for example, detection values obtained by the various sensors included in the refrigeration cycle apparatus 200. As described above, the refrigeration cycle apparatus 200 according to Embodiment 1 is used as an air-conditioning apparatus. Therefore, in the case where the refrigeration cycle apparatus 200 is an air-conditioning apparatus that performs a cooling operation, the thermal-load acquisition unit 302 acquires a cooling load. Furthermore, in the case where the refrigeration cycle apparatus 200 is an air-conditioning apparatus that performs a heating operation, the thermal-load acquisition unit 302 acquires a heating load. It should be noted that the method by which the thermal-load acquisition unit 302 calculates a thermal load is not limited to a specific method. In the past, it has been known that the heat load is found by various methods. In the case where the thermal-load acquisition unit 302 finds a thermal load, it suffices that the thermal-load acquisition unit 302 acquires a thermal load by applying the above method.

The control unit 303 is a function part that controls the components included in the refrigeration cycle apparatus 200, for example, controls the rotation speed of the compressor 100, the opening degree of the first expansion valve 102, and the opening degree of the second expansion valve 233 based on, for example, detection values obtained by detection performed by the various sensors included in the refrigeration cycle apparatus 200 and a thermal load acquired by the thermal-load acquisition unit 302. The storage unit 304 is a function part that stores therein information that is necessary for the thermal-load acquisition unit 302 to acquire a thermal load, information that is necessary for the control unit 303 to control the components included in the refrigeration cycle apparatus 200, or other information.

[Configuration of Compressor 100]

Figure 2:
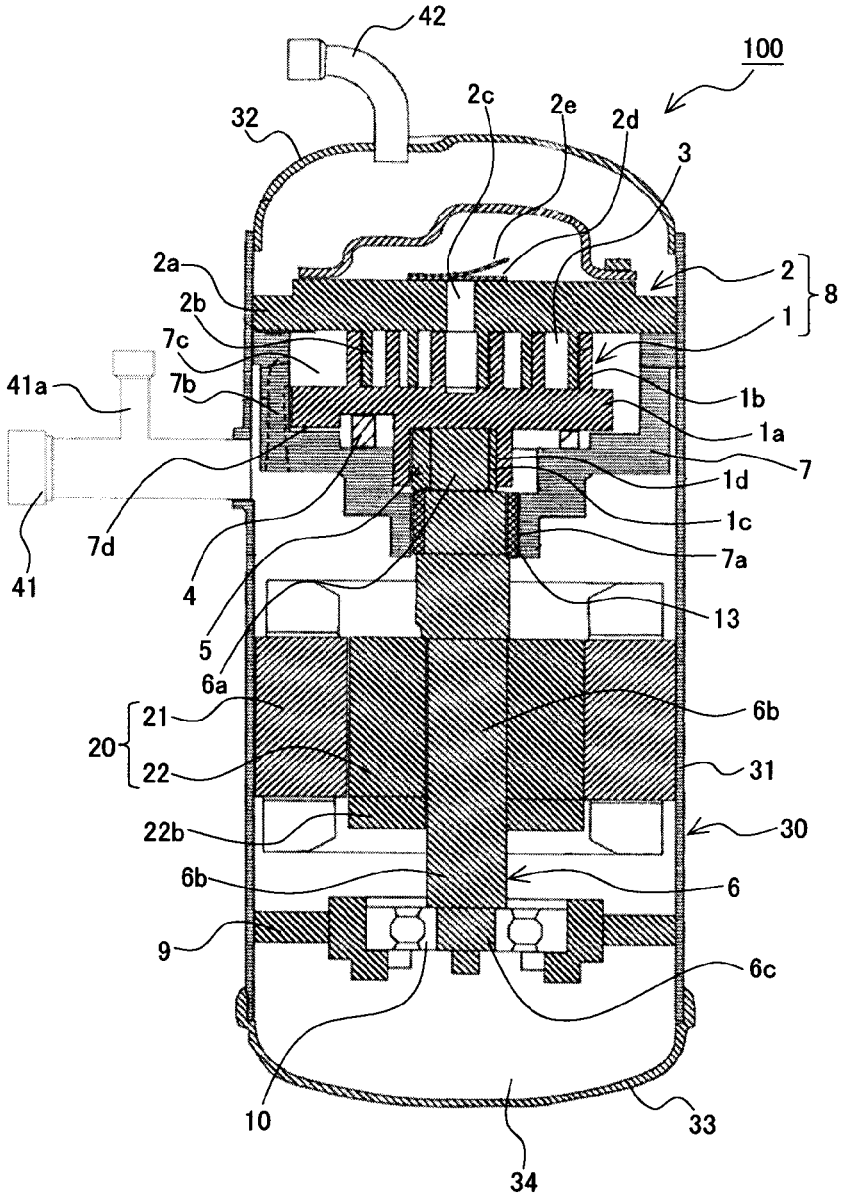
FIG. 2 is a vertical sectional view illustrating a compressor of the refrigeration cycle apparatus according to Embodiment 1 of the present disclosure.

FIG. 2 is a vertical sectional view illustrating a compressor of the refrigeration cycle apparatus according to Embodiment 1 of the present disclosure. Although compressors employing various compression mechanisms can be used as the compressor 100, in Embodiment 1, a scroll compressor is used as the compressor 100. The compressor 100 of Embodiment 1 will be described.

The compressor 100 includes a compression mechanism unit 8, an electric motor 20, and a driving shaft 6. The compression mechanism unit 8 includes an orbiting scroll 1 and a fixed scroll 2. The driving shaft 6 transmits a driving force of the electric motor 20 to the compression mechanism unit 8. Furthermore, the compressor 100 includes a hermetic vessel 30 that houses the compression mechanism unit 8, the electric motor 20, and the driving shaft 6, and forms an outer shell of the compressor 100. In Embodiment 1, the hermetic vessel 30 is made of a tubular member 31, an upper lid member 32, and a lower lid member 33. The tubular member 31 is a tubular member having an upper opening portion and a lower opening portion. The upper lid member 32 is a member that closes the upper opening portion of the tubular member 31. The lower lid member 33 is a member that closes the lower opening portion of the tubular member 31. Furthermore, at a bottom portion of the hermetic vessel 30, an oil sump 34 is provided. The oil sump 34 stores refrigerating machine oil that is supplied to a slide portion of the compression mechanism unit 8 or other units. It should be noted that the refrigerating machine oil stored in the oil sump 34 is drawn by a pump (not illustrated) provided at a lower end of the driving shaft 6, and is supplied to the slide portion of the compression mechanism unit 8 or other units.

In the hermetic vessel 30, a frame 7 and a sub-frame 9 that holds the compression mechanism unit 8 are further housed such that the frame 7 and the sub-frame 9 are located opposite to each other in an axial direction of the driving shaft 6, with the electric motor 20 interposed between the frame 7 and the sub-frame 9. The frame 7 is located above the electric motor 20 and between the electric motor 20 and the compression mechanism unit 8. The sub-frame 9 is located below the electric motor 20. The frame 7 and the sub-frame 9 are fixed to an inner peripheral surface of the tubular member 31 of the hermetic vessel 30 by, for example, shrink fitting.

In the hermetic vessel 30, the driving shaft 6 transmits a driving force of the electric motor 20 to the orbiting scroll 1. The orbiting scroll 1 is eccentrically coupled to the driving shaft 6, and is combined with the frame 7 by an Oldham's ring 4. That is, the Oldham's ring 4 is provided between the orbiting scroll 1 and the frame 7. To be more specific, the Oldham's ring 4 is located between the frame 7 and the base plate 1*a*, which will be described later. The Oldham's ring 4 includes a ring portion and a plurality of keys. On the other hand, in the base plate 1*a* of the orbiting scroll 1, a plurality of key grooves are formed. Some of the plurality of keys of the Oldham's ring 4 are inserted in key grooves formed in the base plate 1*a* of the orbiting scroll 1 such that the keys can be slid. The others of the plurality of keys of the Oldham's ring 4 are inserted in key grooves formed in the frame 7 such that the keys can be slid. When the orbiting scroll 1 is given a driving force by the electric motor 20, the Oldham's ring 4 prevents the orbiting scroll 1 from being rotated on the axis of the orbiting scroll 1. Therefore, when being given a driving force by the electric motor 20, the orbiting scroll 1 revolves without rotating on the axis of the orbiting scroll 1. That is, the orbiting scroll 1 makes an orbiting motion.

At the hermetic vessel 30, a suction tube 41 and a discharge tube 42 are provided. The suction tube 41 is a tube through which low-pressure gas refrigerant is sucked, and the discharge tube 42 is a tube through which high-temperature and high-pressure gas refrigerant is discharged. To be more specific, the suction tube 41 serves as the suction portion of the compressor 100, and is connected to the refrigerant outflow portion of the evaporator 103 by a refrigerant pipe. The suction tube 41 is fixed to the tubular member 31 of the hermetic vessel 30. The discharge tube 42 serves as the discharge portion of the compressor 100, and is connected to the refrigerant inflow portion of the condenser 101 by a refrigerant pipe. The discharge tube 42 is fixed to the upper lid member 32 of the hermetic vessel 30. Furthermore, to the suction tube 41, an injection tube 41*a* is also connected. The injection tube 41*a* is connected to the refrigerant outflow side end 232 of the injection pipe 230.

The compression mechanism unit 8 has a function of compressing refrigerant that has flowed into the hermetic vessel 30 through the suction tube 41 and the injection pipe 41*a*, into high-temperature and high-pressure gas refrigerant, and discharging the high-temperature and high-pressure gas refrigerant to a high-pressure portion provided in an upper region in the hermetic vessel 30. This compression mechanism unit 8 includes the orbiting scroll 1 and the fixed scroll 2.

The fixed scroll 2 includes a base plate 2*a* and a first scroll lap 2*b*. The first scroll lap 2*b* is provided on a lower surface of the base plate 2*a*. The fixed scroll 2 is fixed to the frame 7 by, for example, a bolt (not illustrated).

The orbiting scroll 1 includes the base plate 1*a* and a second scroll lap 1*b*. An upper surface of the base plate 1*a* faces the fixed scroll 2. The second scroll lap 1*b* is provided at the upper surface of the base plate 1*a*. Furthermore, the orbiting scroll 1 includes a boss 1*d* provided at a lower surface of the base plate 1*a*. The boss 1*d* is provided with an orbiting bearing 1*c* that supports an eccentric shaft portion 6*a* of the driving shaft 6, which will be described later, such that the eccentric shaft portion 6*a* can be rotated.

The orbiting scroll 1 and the fixed scroll 2 are set in the hermetic vessel 30, with the second scroll lap 1*b* and the first scroll lap 2*b* combined with each other. In such a manner, the first scroll lap 2*b* of the fixed scroll 2 and the second scroll lap 1*b* of the orbiting scroll 1 are combined, whereby a compression chamber 3 for compression of refrigerant is provided between the first scroll lap 2*b* and the second scroll lap 1*b*. In other words, the second scroll lap 1*b* is combined with the first scroll lap 2*b* to form along with the first scroll lap 2*b* the compression chamber 3.

In a substantially central portion of the base plate 2*a* of the fixed scroll 2, a discharge port 2*c* is provided as a port through which refrigerant compressed in the compression chamber 3 is discharged. At the discharge port 2*c*, a discharge valve 2*d* is provided to prevent backflow of refrigerant. At an upper portion of the discharge valve 2*d*, a valve guard 2*e* is provided to prevent the discharge valve 2*d* from being excessively bent.

The frame 7 supports the orbiting scroll 1 from below, and is provided to face the lower surface of the base plate 1*a* of the orbiting scroll 1. The frame 7 has a thrust surface 7*d* that faces the lower surface of the base plate 1*a* of the orbiting scroll 1. The thrust surface 7*d* is a surface that supports the orbiting scroll 1 such that the orbiting scroll 1 can orbit, and also supports a load that acts on the orbiting scroll 1 at a process of compressing refrigerant. Furthermore, in the frame 7, a through-hole 7*b* is formed as a hole through which refrigerant sucked from the suction tube 41 and the injection tube 41*a* is guided into the compression mechanism unit 8. To be more specific, a suction chamber 7*c* is formed on outer peripheral sides of the first scroll lap 2*b* of the fixed scroll 2 and the second scroll lap 1*b* of the orbiting scroll 1. Moreover, the compression mechanism unit 8 sucks refrigerant from the suction chamber 7*c* through the refrigerant suction port of the compression mechanism unit 8. Therefore, the through-hole 7*b* guides to the suction chamber 7*c*, the refrigerant sucked from the suction tube 41 and the injection tube 41*a*. The refrigerant suction port of the compression mechanism unit 8 is a space between an outer peripheral edge of the second scroll lap 1*b* of the orbiting scroll 1 and the first scroll lap 2*b* of the fixed scroll 2. Also, the refrigerant suction port of the compression mechanism unit 8 is a space between the second scroll lap 1*b* of the orbiting scroll 1 and an outer peripheral edge of the first scroll lap 2*b* of the fixed scroll 2.

It should be noted that the configuration of the suction chamber 7*c* as illustrated in FIG. 2 is merely an example. To be more specific, the frame 7 as illustrated in FIG. 2 includes a peripheral wall that is located on an outer peripheral side of the base plate 1*a* of the orbiting scroll 1, and that protrudes upwards in such a manner as to cover an outer peripheral side of the orbiting scroll 1. That is, the peripheral wall of the frame 7 is located between the orbiting scroll 1 and the tubular member 31 of the hermetic vessel 30. To the peripheral wall of the frame 7, the base plate 1*a* of the fixed scroll 2 is fixed by, for example, a bolt (not illustrated). That is, the peripheral wall of the frame 7 forms an outer peripheral wall surface of the suction chamber 7*c*. However, the configuration of the suction chamber 7*c* is not limited to the configuration as illustrated in FIG. 2, as long as the suction chamber 7*c* is provided on the outer peripheral sides of the first scroll lap 2*b* of the fixed scroll 2 and the second scroll lap 1*b* of the orbiting scroll 1.

Figure 5:
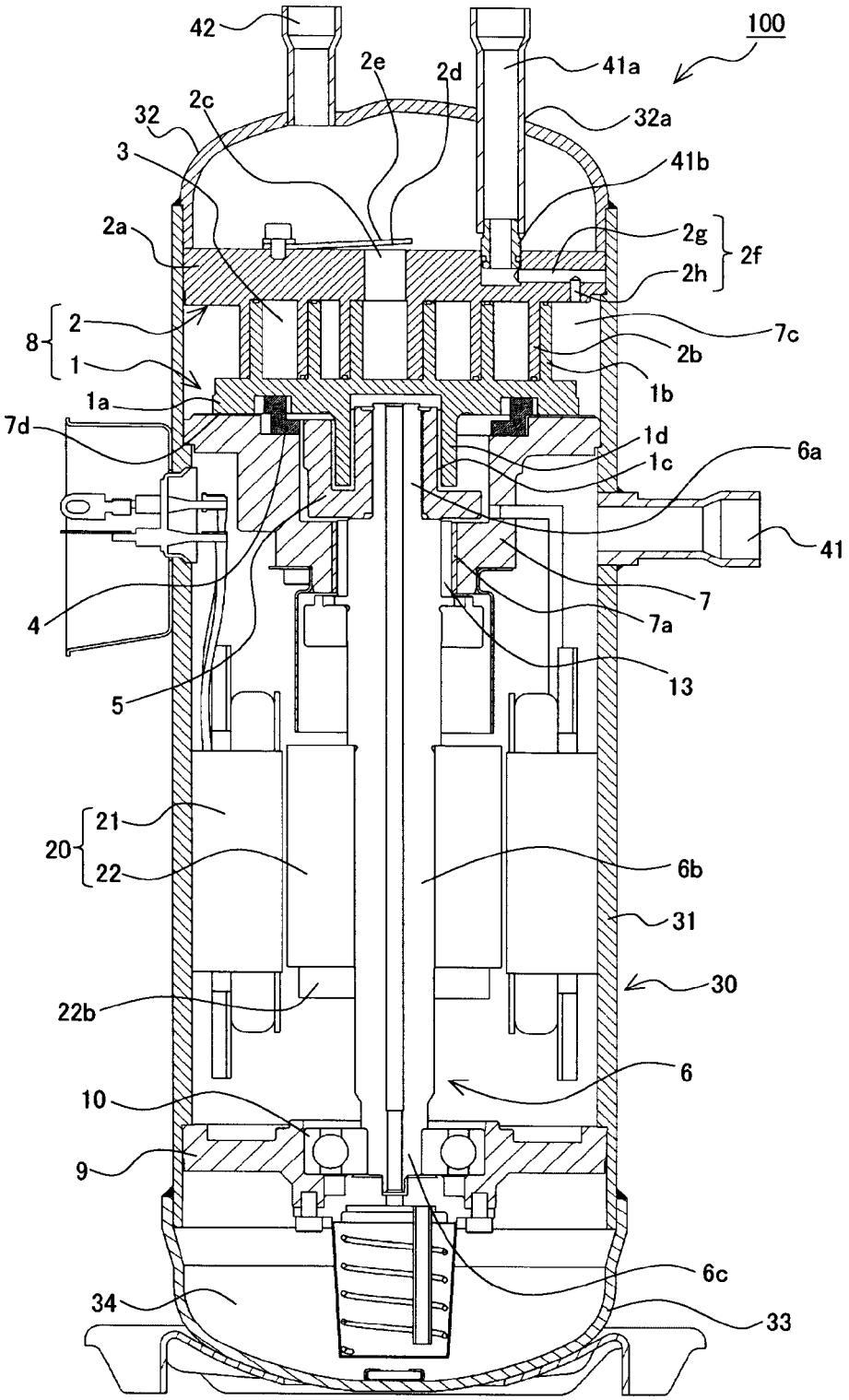
FIG. 5 is a longitudinal sectional view illustrating still another example of the compressor of the refrigeration cycle apparatus according to Embodiment 1 of the present disclosure.

For example, the suction chamber 7*c* may be configured as illustrated in FIG. 5, which will be described later. To be more specific, the frame 7 as illustrated in FIG. 5 includes no peripheral wall corresponding to the peripheral wall included in the frame 7 as illustrated in FIG. 2. That is, no peripheral wall is provided between the orbiting scroll 1 and the tubular member 31 of the hermetic vessel 30. In the frame 7 having such a configuration, the tubular member 31 of the hermetic vessel 30 forms the outer peripheral wall surface of the suction chamber 7*c*. Furthermore, in the case where the frame 7 does not include the above peripheral wall, the fixed scroll 2 is fixed to, for example, the tubular member 31 of the hermetic vessel 30. In the case where the frame 7 does not include the peripheral wall, the first scroll lap 2*b* of the fixed scroll 2 and the second scroll lap 1*b* of the orbiting scroll 1 can be provided at more outward locations, and the compression mechanism unit 8 can be made larger in size than in the case where the frame 7 includes the peripheral wall. That is, in the case where the frame 7 does not include the peripheral wall, the function of the compressor 100 can be improved, as compared with the case where the frame 7 includes the peripheral wall.

The electric motor 20 that gives a driving force to the driving shaft 6 includes a stator 21 and a rotor 22. The stator 21 is supplied with electric power from an inverter (not illustrated). The rotor 22 is provided on an inner peripheral side of the stator 21, and is connected to the main shaft portion 6*b* of the driving shaft 6, which will be described later, by, for example, shrink fitting. Furthermore, in order to balance the entire rotating system of the compressor 100, a balance weight 22*b* is fixed to the rotor 22. Although it is not illustrated, a balance weight is also fixed to the driving shaft 6 in order to balance the entire rotating system of the compressor 100.

The driving shaft 6 includes the eccentric shaft portion 6*a*, the main shaft portion 6*b*, and a sub shaft portion 6*c*. The eccentric shaft portion 6*a* is an upper portion of the driving shaft 6. The sub shaft portion 6*c* is a lower portion of the driving shaft 6.

The main shaft portion 6*b* is supported by a main bearing 7*a* provided at the frame 7 such that the main shaft portion 6*b* can be rotated. In Embodiment 1, a sleeve 13 is attached to an outer peripheral side of the main shaft portion 6*b*. The sleeve 13 is supported by the main bearing 7*a* such that the sleeve 13 can be rotated. The sleeve 13 compensates for the inclination between the main shaft portion 6*b* and the main bearing 7*a*.

The sub-frame 9 is provided with a sub shaft bearing 10. The sub shaft bearing 10 supports the sub shaft portion 6*c* at a location below the electric motor 20 such that the sub shaft portion 6*c* can be rotated in a radial direction.

The axis of the eccentric shaft portion 6*a* is displaced from that of the main shaft portion 6*b*. This eccentric shaft portion 6*a* is supported by the boss 1*d* of the orbiting scroll 1 such that the eccentric shaft portion 6*a* can be rotated. In Embodiment 1, a slider 5 is provided on an outer peripheral side of the eccentric shaft portion 6*a* such that the slider 5 can be slid over the eccentric shaft portion 6*a*. Furthermore, in Embodiment 1, the orbiting bearing 1*c* is provided on an inner peripheral side of the boss 1*d*. Furthermore, the slider 5 is inserted on an inner peripheral side of the orbiting bearing 1*c* such that the slider 5 can be rotated. That is, in Embodiment 1, the eccentric shaft portion 6*a* is supported by the boss 1*d*, with the slider 5 and the orbiting bearing 1*c* interposed between the eccentric shaft portion 6*a* and the boss 1*d*, such that the eccentric shaft portion 6*a* can be rotated.

When the main shaft portion 6*b* is rotated, the eccentric shaft portion 6*a* is rotated in a state in which the axis of the eccentric shaft portion 6*a* is displaced from the axis of the main shaft portion 6*b* by a radius equal to a distance between the axis of the main shaft portion 6*b* and the axis of the eccentric shaft portion 6*a*. As a result, the orbiting scroll 1, which is coupled to the eccentric shaft portion 6*a*, with the slider 5 and the orbiting bearing 1*c* interposed between the orbiting scroll 1 and the eccentric shaft portion 6*a*, is moved relative to the main shaft portion 6*b* to rotate in the circle with the above radius. In other words, the orbiting scroll 1 is moved relative to the fixed scroll 2 that has been fixed, to rotate in the circle with the above orbiting radius. In this case, as described above, the Oldham's ring 4 prevents the orbiting scroll 1 from being rotated on the axis of the orbiting scroll 1. Thus, the orbiting scroll 1 is rotated relative to the fixed scroll 2 in the circle with the above orbiting radius.

As described above, the pump (not illustrated) is provided at the lower end of the driving shaft 6. When the driving shaft 6 is rotated, the pump draws the refrigerating machine oil stored in the oil sump 34. In the driving shaft 6, an oil feed flow passage is provided in such a manner as to extend through the driving shaft 6 in an axial direction. The refrigerating machine oil drawn by the pump is fed through the oil feed flow passage to slide portions of bearing parts or other parts. The oil that has lubricated the orbiting bearing 1*c* is stored in an internal space located inward of the frame 7, and then lubricates the thrust surface 7*d* and the Oldham's ring 4. The refrigerating machine oil that has lubricated the thrust surface 7*d* and the Oldham's ring 4 flows into a space between the frame 7 and the sub-frame 9 through a pipe (not illustrated) through which an upper space located above the frame 7 and a lower space located below the frame 7 communicate with each other. This refrigerating machine oil returns to the oil sump 34 through the sub-frame 9.

[Description of Operation of Refrigeration Cycle Apparatus 200]

An operation of the refrigeration cycle apparatus 200 having the above configuration will be described. In the following, an operation of the compressor 100 is described, and subsequently, an operation of the entire refrigeration cycle apparatus 200 is described. Furthermore, in the following, the operation of the refrigeration cycle apparatus 200 is described by referring to by way of example the case where the refrigeration cycle apparatus 200 is used as an air-conditioning apparatus configured to perform a cooling operation.

When the stator 21 of the electric motor 20 is supplied with electric power from an inverter (not illustrated), a magnetic field generated at the stator 21 acts on the rotor 22, thereby generating a rotation torque at the rotor 22. As a result, the rotor 22 is rotated. Furthermore, the driving shaft 6 is rotated together with the rotor 22, whereby the orbiting scroll 1 is caused to make an orbiting motion, because of rotation of the driving shaft 6. Thus, refrigerant that is present in the suction chamber 7*c* is sucked into the compression chamber 3 of the compression mechanism unit 8. It should be noted that the rotor 22 is rotated at a rotation speed corresponding to the frequency of a driving current that is input from the inverter to the stator 21. That is, the controller 300 controls the rotation speed of the compressor 100 by controlling the frequency of a driving current that is inputted from the inverter to the stator 21.

When the refrigerant that is present in the suction chamber 7*c* is sucked into the compression chamber 3 of the compression mechanism unit 8, the pressure of the lower space below the frame 7 that communicates with the suction chamber 7*c* via the through-hole 7*b* drops. As a result, a low-pressure gas refrigerant flows into the lower space below the frame 7 from the suction tube 41, which communicates with the lower space. Furthermore, when the second expansion valve 233 of the injection pipe 230 is in the opened state, refrigerant also flows in from the injection tube 41*a*. The refrigerant that has flowed into the lower space below the frame 7 flows into the suction chamber 7*c* through the through-hole 7*b*, and is sucked into the compression chamber 3 of the compression mechanism unit 8.

Because of a geometric change in volume of the compression chamber 3 that is made by the orbiting motion of the orbiting scroll 1, the pressure of the refrigerant sucked into the compression chamber 3 is raised from a low pressure to a high pressure while the refrigerant is flowing toward a central portion of the compression mechanism unit 8. Then, the gas refrigerant whose pressure has been raised to the high pressure pushes and opens the discharge valve 2*d*, and is then discharged out of the compression mechanism unit 8 and further discharged out of the compressor 100 through the discharge tube 42.

The high-temperature and high-pressure gas refrigerant discharged from the compressor 100 is cooled by outdoor air at the condenser 101 to condense into high-pressure liquid refrigerant. The high-pressure liquid refrigerant that has flowed out of the condenser 101 is expanded at the first expansion valve 102 to change into low-temperature and low-pressure two-phase gas-liquid refrigerant. The low-temperature and low-pressure two-phase gas-liquid refrigerant that has flowed out of the first expansion valve 102 flows into the evaporator 103 and cools air in an air-conditioned space at the evaporator 103. At that time, the low-temperature and low-pressure two-phase gas-liquid refrigerant receives heat from the air of the air-conditioned space to evaporate and change into a low-pressure gas refrigerant. The low-pressure gas refrigerant that has flowed out of the evaporator 103 is sucked into the compressor 100, and re-compressed into high-temperature and high-pressure gas refrigerant.

During the above operation of the refrigeration cycle apparatus 200, the control unit 303 of the controller 300 controls the rotation speed of the compressor 100 based on a cooling load and adjusts the flow rate of refrigerant that flows in the evaporator 103, thereby adjusting the capacity of the refrigeration cycle apparatus 200. More specifically, as the cooling load increases, the control unit 303 of the controller 300 increases the rotation speed of the compressor 100 and increases the flow rate of refrigerant that flows in the evaporator 103, thereby increasing the capacity of the refrigeration cycle apparatus 200. On the other hand, as the cooling load decreases, the control unit 303 of the controller 300 decreases the rotation speed of the compressor 100 and decreases the flow rate of refrigerant that flows in the evaporator 103, thereby decreasing the capacity of the refrigeration cycle apparatus 200.

It should be noted that when the rotation speed of a compressor is too low, the compressor becomes unable to sufficiently supply refrigerating machine oil to the slide portion, as a result of which the reliability of the compressor is reduced. Therefore, a compressor whose rotation speed is variable has a specified lower limit rotation speed in order to ensure reliability of the compressor. Thus, in an existing air-conditioning apparatus, even when a compressor is driven at a lower limit rotation speed, if the capacity is large for a cooling load, the air-conditioning apparatus reduces the capacity by performing the intermittent operation in which stopping and starting of the compressor are repeated. During this intermittent operation, it is necessary to temporarily equalize the pressures of high-pressure refrigerant and low-pressure refrigerant in view of the durability of components included in the refrigeration cycle apparatus, whereby heat transfers between the refrigerants. Therefore, in the case where the intermittent operation is performed, the operation efficiency of the air-conditioning apparatus is reduced.

In view of the above, the refrigeration cycle apparatus 200 according to Embodiment 1 is operated in the following manner, and further reduces, when the load is low, repetition of stopping and starting of the compressor 100, as compared with the existing refrigeration cycle apparatus.

Figure 3:
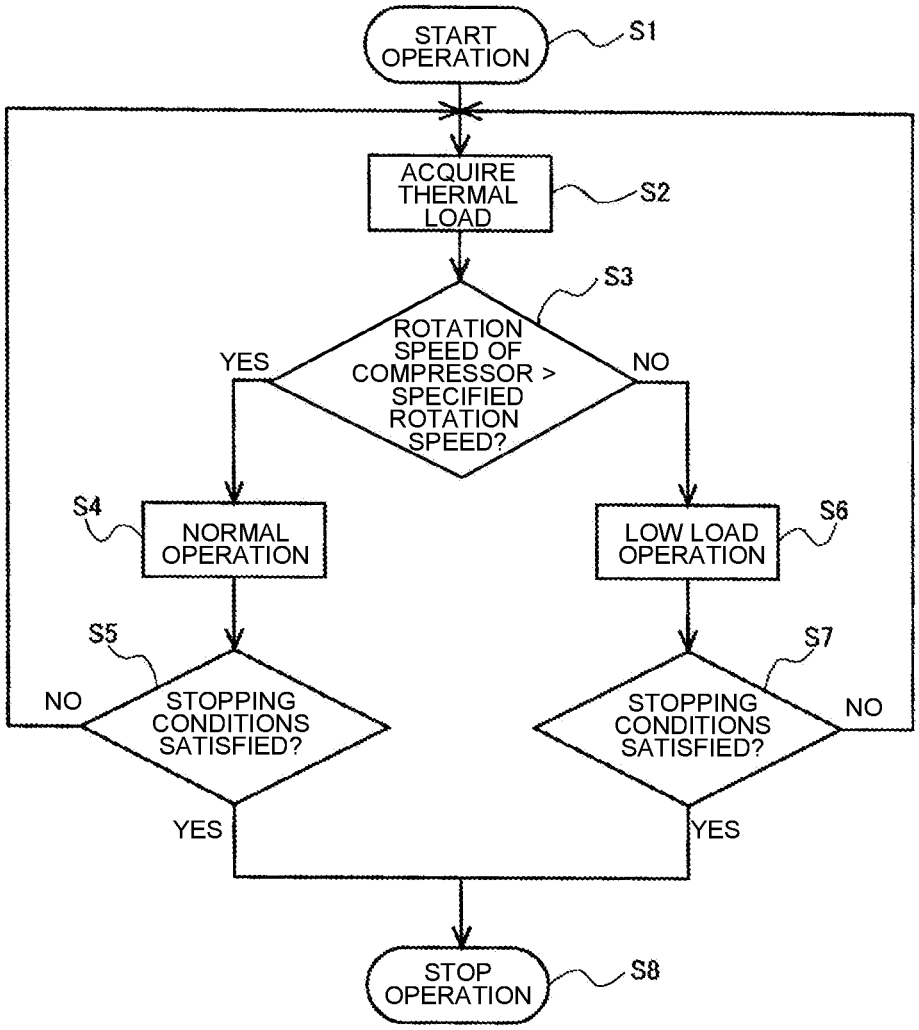
FIG. 3 is a flow chart indicating operations of the refrigeration cycle apparatus according to Embodiment 1 of the present disclosure.

FIG. 3 is a flow chart indicating operations of the refrigeration cycle apparatus according to Embodiment 1 of the present disclosure.

In the case where conditions for starting the operation of the refrigeration cycle apparatus 200 are satisfied, in step S1, the controller 300 starts the operation of the refrigeration cycle apparatus 200. For example, the case where the conditions for starting the operation of the refrigeration cycle apparatus 200 are satisfied corresponds to the case in which an instruction to start the operation is given from, for example, a remote control unit (not illustrated) to the controller 300.

After step S1, in step S2, the thermal-load acquisition unit 302 of the controller 300 acquires a thermal load. As described above, the refrigeration cycle apparatus 200 is used as an air-conditioning apparatus configured to perform the cooling operation. Therefore, the thermal-load acquisition unit 302 acquires a cooling load.

After step S2, the control unit 303 of the controller 300 causes a normal operation in step S4 or a low load operation in step S6 to be performed based on the cooling load acquired by the thermal-load acquisition unit 302. More specifically, when the rotation speed of the compressor 100 that is determined depending on the cooling load acquired by the thermal-load acquisition unit 302 is higher than a specified rotation speed, the control unit 303 causes the normal operation in step S4 to be performed. That is, in the case where the answer to the question in step S3 is yes, the control unit 303 causes the normal operation in step S4 to be performed. By contrast, in the case where the cooling load is low and the rotation speed of the compressor 100 that is determined depending on the cooling load acquired by the thermal-load acquisition unit 302 is lower than or equal to the specified rotation speed, the control unit 303 causes the low load operation in step S6 to be performed. That is, in the case where the answer to the question in step S3 is no, the control unit 303 causes the low load operation in step S6 to be performed. In Embodiment 1, the specified rotation speed is a lower limit rotation speed of the compressor 100. The lower limit rotation speed of the compressor 100 is, for example, 15 rps.

During the normal operation in step S4, the control unit 303 drives the compressor 100 at a rotation speed determined depending on the cooling load acquired by the thermal-load acquisition unit 302. It should be noted that the larger the cooling load, the higher the rotation speed of the compressor 100. Furthermore, as the rotation speed of the compressor 100 increases, the temperature of refrigerant that is discharged from the compressor 100 rises. In addition, when the temperature of refrigerant that is discharged from the compressor 100 excessively rises, for example, the reliability of the compressor 100 is reduced. Therefore, in the compressor 100, an upper limit rotation speed is also determined. Thus, during the normal operation in step S4, the control unit 303 controls the rotation speed of the compressor 100 at a rotation speed that is higher than the lower limit rotation speed and lower than or equal to the upper limit rotation speed.

Furthermore, in the refrigeration cycle apparatus 200 according to Embodiment 1, which includes the injection pipe 230, the control unit 303 executes the following control to reduce an excessive rise in the temperature of refrigerant that is discharged from the compressor 100. To be more specific, in the case where a temperature detected by the temperature sensor 310 provided at a refrigerant pipe connecting the compressor 100 and the condenser 101 is lower than an upper limit temperature specified in advance, the control unit 303 keeps the second expansion valve 233 of the injection pipe 230 in the closed state. By contrast, in the case where the temperature detected by the temperature sensor 310 is higher than or equal to the upper limit temperature, the control unit 303 opens the second expansion valve 233 of the injection pipe 230.

As a result, refrigerant that has passed through the injection pipe 230 and has been expanded at the second expansion valve 233 flows into the compressor 100 in addition to the gas refrigerant that has flowed out of the evaporator 103. The temperature of the refrigerant that has passed through the injection pipe 230 and has been expanded at the second expansion valve 233 is lower than that of the gas refrigerant that has flowed out of the evaporator 103. Therefore, when the second expansion valve 233 of the injection pipe 230 is opened, the temperature of refrigerant that is sucked by the compression mechanism unit 8 is reduced, and the temperature of refrigerant that is discharged from the compressor 100 is also reduced. That is, it is possible to reduce an excessive rise in the temperature of refrigerant that is discharged from the compressor 100.

After step S4, in the case where conditions for stopping the operation are satisfied, that is, in the case where the answer to the question in step S5 is yes, in step S8, the controller 300 stops the operation of the refrigeration cycle apparatus 200. For example, the case where the conditions for stopping the operation are satisfied corresponds to the case where an instruction to stop the operation is given from, for example, the remote control unit (not illustrated) to the controller 300. On the other hand, after step S4, in the case where the conditions for stopping the operation are not satisfied, that is, in the case where the answer to the question in step S5 is no, the step to be carried out by the controller 300 returns to step S2.

During the low load operation of step S6, the control unit 303 drives the compressor 100 at the specified rotation speed. That is, in Embodiment 1, the control unit 303 drives the compressor 100 at the lower limit rotation speed. Then, the control unit 303 opens the second expansion valve 233 of the injection pipe 230. During the low load operation in step S6, the rotation speed of the compressor 100 is low. Thus, the temperature detected by the temperature sensor 310 is lower than the upper limit temperature. That is, during the low load operation in step S6, the control unit 303 opens the second expansion valve 233 under conditions where the second expansion valve 233 is in the closed state during the normal operation in step S4. In other words, during the low load operation in step S6, the control unit 303 opens the second expansion valve 233 under conditions where an existing air-conditioning apparatus including an injection pipe does not open an expansion valve provided at the injection pipe.

When the second expansion valve 233 is opened, part of refrigerant that has flowed out of the condenser 101 returns to the compressor 100 through the injection pipe 230 without passing through the evaporator 103. Thus, because of opening of the second expansion valve 233, it is possible to reduce the flow rate of refrigerant that flows through the evaporator 103, and to reduce the heat-exchange capability of the evaporator 103 without decreasing the rotation speed of the compressor 100. Therefore, in the refrigeration cycle apparatus 200 according to Embodiment 1, by performing the above low load operation under a low load, it is possible to further reduce repetition of stopping and starting of the compressor 100 than in the existing refrigeration cycle apparatus. It should be noted that in the case of controlling the opening degree of the second expansion valve 233 during the low load operation, the control unit 303 may control only closing and opening of the second expansion valve 233 or may control the opening degree at the time of opening the second expansion valve 233. That is, at the time of opening the second expansion valve 233, the control unit 303 may control how much the second expansion valve is opened. For example, during the low load operation, the control unit 303 may increase the opening degree of the second expansion valve 233 as the cooling load decreases.

In Embodiment 1, the control unit 303 performs the following control to reduce compression of liquid by the compressor 100. Specifically, the lower the temperature of refrigerant that is discharged from the compressor 100, the stronger the possibility that compression of liquid by the compressor 100 will be performed. Therefore, when the temperature detected by the temperature sensor 310 provided at the refrigerant pipe connecting the compressor 100 and the condenser 101 drops to a lower limit temperature specified in advance, the control unit 303 stops the compressor 100 to reduce compression of liquid by the compressor 100.

After step S6, in the case where the conditions for stopping the operation are satisfied, that is, in the case where the answer to the question in step S7 is yes, in step S8, the controller 300 stops the operation of the refrigeration cycle apparatus 200. On the other hand, after step S6, in the case where the conditions for stopping the operation are not satisfied, that is, in the case where the answer to the question in step S7 is no, the step to be carried out by the controller 300 returns to step S2.

As described above, the refrigeration cycle apparatus according to Embodiment 1 includes the refrigeration cycle circuit 201 in which the compressor 100, the condenser 101, the first expansion valve 102, and the evaporator 103 are connected by refrigerant pipes. Furthermore, the refrigeration cycle apparatus 200 includes the injection pipe 230, the second expansion valve 233 provided at the injection pipe 230, and the controller 300 that controls the rotation speed of the compressor 100 and the opening degree of the second expansion valve 233. The injection pipe 230 has the refrigerant inflow side end 231 connected between the condenser 101 and the first expansion valve 102, and has the refrigerant outflow side end 232 connected to the suction side of the compressor 100. The controller 300 is configured to perform a low load operation in which refrigerant is made to flow through the injection pipe 230, in the case of reducing the heat-exchange capability of the evaporator 103 when the rotation speed of the compressor 100 is the specified rotation speed.

In the refrigeration cycle apparatus 200 according to Embodiment 1, during the low load operation, refrigerant is made to flow through the injection pipe 230, thereby reducing the flow rate of refrigerant that flows in the evaporator 103, and thus reducing the heat-exchange capability of the evaporator 103. Thus, in the refrigeration cycle apparatus 200 according to Embodiment 1, during the low load operation, it is possible to reduce the capacity of the refrigeration cycle apparatus 200 without changing the rotation speed of the compressor 100. Therefore, in the refrigeration cycle apparatus 200 according to Embodiment 1, in the case where the capacity is large for a thermal load even when the compressor 100 is being driven at the lower limit rotation speed, the capacity can be reduced by causing refrigerant to flow through the injection pipe 230. Accordingly, in the refrigeration cycle apparatus 200 according to Embodiment 1, when the load is low, it is possible to further reduce repetition of stopping and starting of the compressor 100 than in the existing refrigerant cycle apparatus.

It should be noted that the compressor 100 as illustrated in FIG. 2 is an example of the compressor 100 according to Embodiment 1. The compressor 100 may be configured, for example, in the following manner.

[Modification 1 of Compressor 100]

Figure 4:
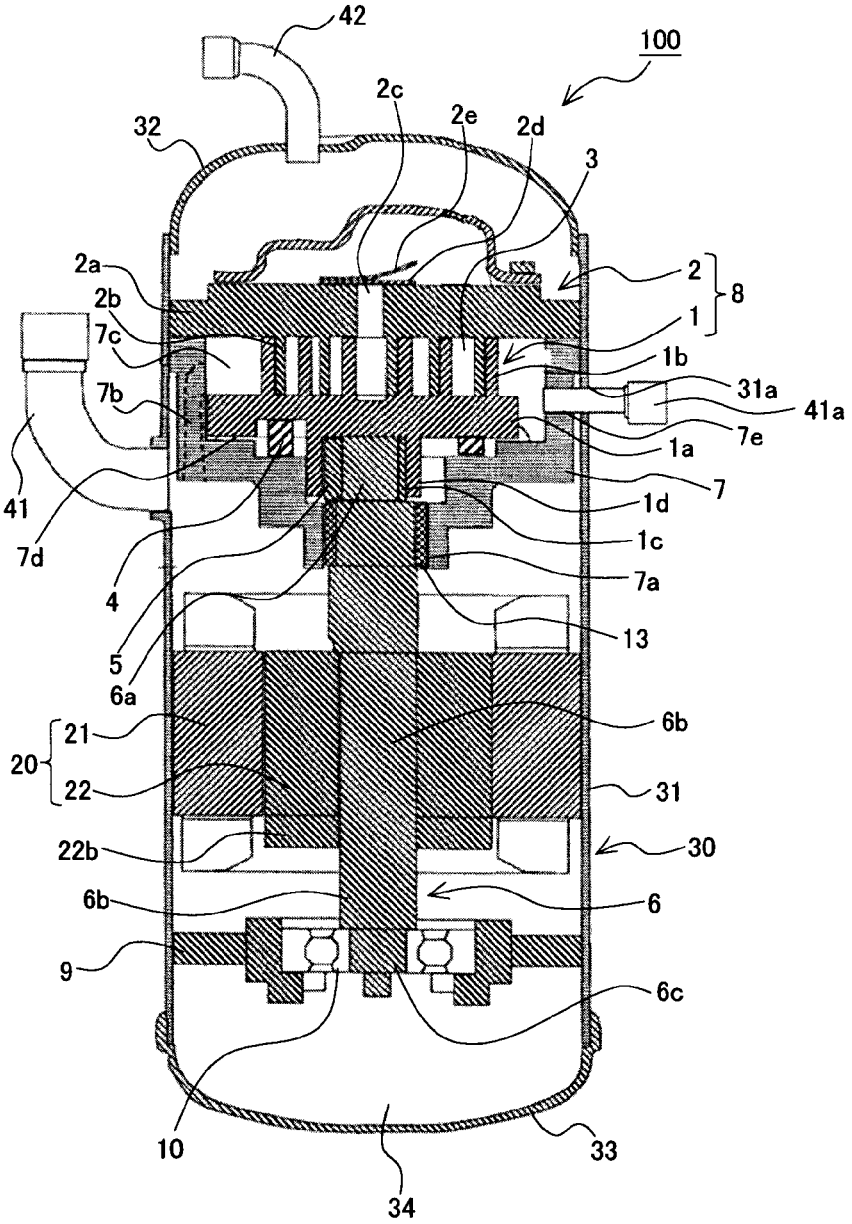
FIG. 4 is a vertical sectional view illustrating another example of the compressor of the refrigeration cycle apparatus according to Embodiment 1 of the present disclosure.

FIG. 4 is a vertical longitudinal sectional view illustrating another example of the compressor of the refrigeration cycle apparatus according to Embodiment 1 of the present disclosure.

In the compressor 100 as illustrated in FIG. 2, the injection tube 41*a* is connected to the suction tube 41. Therefore, the compressor 100 as illustrated in FIG. 2 is configured such that refrigerant that flows through the injection pipe 230 flows into the lower space below the frame 7 in the hermetic vessel 30 and then flows into the suction chamber 7*c* through the through-hole 7*b* formed in the frame 7. By contrast, the compressor 100 as illustrated in FIG. 4 is configured such that when refrigerant flows from the injection pipe 230 into the hermetic vessel 30, refrigerant flowing through the injection pipe 230 flows into the suction chamber 7*c*.

More specifically, in the compressor 100 as illustrated in FIG. 4, a through-hole 31*a* is formed in the tubular member 31 of the hermetic vessel 30. The injection tube 41*a* is inserted in the through-hole 31*a*, is fixed to the tubular member 31, and communicates with the suction chamber 7*c*. It should be noted that the frame 7 of the compressor 100 as illustrated in FIG. 4 includes a peripheral wall that protrudes upwards in such a manner as to cover the outer peripheral side of the orbiting scroll 1. That is, the peripheral wall of the frame 7 is located between the orbiting scroll 1 and the tubular member 31 of the hermetic vessel 30. Therefore, in the frame 7 of the compressor 100 as illustrated in FIG. 4, a through-hole 7*e* is formed to cause the suction chamber 7*c* and the injection tube 41*a* to communicate with each other. In the case where the frame 7 does not include the peripheral wall, the frame 7 does not need to have the through-hole 7*e*.

The refrigerant that flows from the injection pipe 230 into the hermetic vessel 30 may be liquid refrigerant. Alternatively, the refrigerant that flows from the injection pipe 230 into the hermetic vessel 30 may contain liquid refrigerant. In the case where liquid refrigerant flows into the hermetic vessel 30 of the compressor 100 as illustrated in FIG. 1, the liquid refrigerant flows into the lower space below the frame 7, and thus may flow into the oil sump 34, and as a result, the refrigerating machine oil stored in the oil sump 34 may be diluted with the liquid refrigerant. Moreover, if the refrigerating machine oil stored in the oil sump 34 is excessively diluted with the liquid refrigerant, lubrication of the slide portion of the compressor 100 may be insufficient, and the reliability of the compressor 100 may be reduced.

By contrast, in the compressor 100 as illustrated in FIG. 4, when refrigerant flows from the injection pipe 230 into the hermetic vessel 30, the refrigerant flowing through the injection pipe 230 flows into the suction chamber 7*c* without passing through the lower space below the frame 7. Thus, in the compressor 100 as illustrated in FIG. 4, it is possible to further reduce dilution of the refrigerating machine oil stored in the oil sump 34 with the liquid refrigerant than in the compressor 100 as illustrated in FIG. 1, and thus possible to improve the reliability of the compressor 100.

[Modification 2 of Compressor 100]

FIG. 5 is a vertical sectional view illustrating still another example of the compressor of the refrigeration cycle apparatus according to Embodiment 1 of the present disclosure.

In the compressor 100 as illustrated in FIG. 5, a through-hole 32*a* is formed in the upper lid member 32 of the hermetic vessel 30. The injection tube 41*a*, which is to be connected to the injection pipe 230, is inserted in the through-hole 32*a*, and is fixed to the upper lid member 32, for example, by brazing. Furthermore, for example, in the base plate 2*a* of the fixed scroll 2, a communication flow passage 2*f* is provided to communicate with the suction chamber 7*c*. In Embodiment 1, a horizontal hole 2*g* and a vertical hole 2*h* form the communication flow passage 2*f*. The horizontal hole 2*g* is a hole that extends in a lateral direction from an outer peripheral surface of the base plate 2*a*. The vertical hole 2*h* is a hole that causes the horizontal hole 2*g* and the suction chamber 7*c* to communicate with each other. Furthermore, the injection tube 41*a* communicates with the communication flow passage 2*f*. That is, the injection tube 41*a* communicates with the suction chamber 7*c* via the communication flow passage 2*f*. In Embodiment 1, the injection tube 41*a* communicates with the communication flow passage 2*f* via an attachment 41*b*. Alternatively, the injection tube 41*a* may be directly connected to the communication flow passage 2*f*, for example, by inserting a distal end of the injection tube 41*a* into the communication flow passage 2*f*.

In the compressor 100 as illustrated in FIG. 5, when refrigerant flows from the injection pipe 230 into the hermetic vessel 30, the refrigerant flowing through the injection pipe 230 flows into the suction chamber 7*c* without passing through the lower space below the frame 7, as in the compressor 100 as illustrated in FIG. 4. Therefore, the compressor 100 as illustrated in FIG. 5 can obtain the same advantages as the compressor 100 as illustrated in FIG. 4.

Furthermore, the compressor 100 as illustrated in FIG. 5 can obtain the following advantage in addition to the advantages obtained by the compressor 100 as illustrated in FIG. 4. To be more specific, in the case where the compressor as illustrated in FIG. 4 is manufactured, first, the frame 7 is fixed to the tubular member 31 of the hermetic vessel 30 by shrink fitting. After that, the injection tube 41*a* is inserted into the through-hole 31*a* of the tubular member 31. Then, the injection tube 41*a* is fixed to the tubular member 31 of the hermetic vessel 30 by, for example, brazing. Therefore, in the compressor 100 as illustrated in FIG. 4, when the injection tube 41*a* is fixed to the tubular member 31 of the hermetic vessel 30 by, for example, brazing, the frame 7 and the tubular member 31 may be distorted by heat.

On the other hand, in the case where the compressor 100 as illustrated in FIG. 5 is manufactured, first, the injection tube 41*a* is inserted into the through-hole 32*a* of the upper lid member 32 of the hermetic vessel 30, and then the injection tube 41*a* and the upper lid member 32 are fixed to each other by, for example, brazing. After that, in the process of attaching the upper lid member 32 to the tubular member 31, the attachment 41*b* attached to a distal end of the injection tube 41*a* is inserted into the communication flow passage 2*f* of the fixed scroll 2. Then, the tubular member 31 and the upper lid member 32 are fixed to each other by, for example, brazing. In the compressor as illustrated in FIG. 5 that can be manufactured to have such a configuration, it is possible to further reduce deformation of the frame 7 that occurs due to heat during fixation of the injection tube 41*a* than in the compressor 100 as illustrated in FIG. 4. Accordingly, the compressor 100 as illustrated in FIG. 5 can be manufactured with a higher accuracy than the compressor 100 as illustrated in FIG. 4.

Embodiment 2

Figure 6:
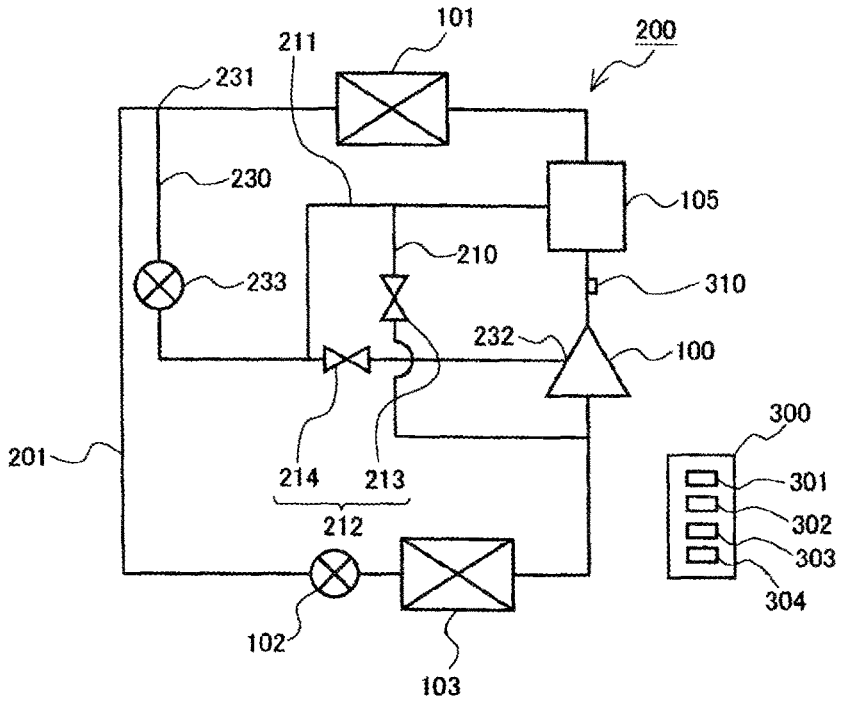
FIG. 6 is a refrigerant circuit diagram of a refrigeration cycle apparatus according to Embodiment 2 of the present disclosure.

FIG. 6 is a refrigerant circuit diagram of a refrigeration cycle apparatus according to Embodiment 2 of the present disclosure. Regarding Embodiment 2, matters that will not particularly be described are similar to those of Embodiment 1, and functions and components that are similar to those of Embodiment 1 will be described with reference to the same reference signs.

The refrigeration cycle apparatus 200 according to Embodiment 2 includes an oil branch pipe 211 in addition to the components of the refrigeration cycle apparatus 200 according to Embodiment 1. One end of the oil branch pipe 211 is connected to the oil return pipe 210. The other end of the oil branch pipe 211 is connected to part of the injection pipe 230 that is located downstream of the second expansion valve 233. The refrigeration cycle apparatus 200 according to Embodiment 2 is configured such that during the low load operation, refrigerating machine oil that has passed through the oil return pipe 210 and the oil branch pipe 211 and been separated by the oil separator 105 flows into the injection pipe 230.

The refrigeration cycle apparatus 200 according to Embodiment 2 includes an oil distribution device 212, and during the normal operation, regulates the inflow of the refrigerating machine oil separated by the oil separator 105 into the injection pipe 230. Specifically, the oil distribution device 212 includes on-off valves 213 and 214. The on-off valve 213 is provided at part of the oil return pipe 210 that is located downstream of part of the oil return pipe 210 that is connected to the oil branch pipe 211. The on-off valve 214 is provided at part of the injection pipe 230 that is downstream of part of the injection pipe 230 that is connected to the oil branch pipe 211. The on-off valves 213 and valve 214 may be on-off valves that can be simply opened and closed or may be on-off valves whose opening degrees are adjustable.

The on-off valves 213 and 214 are controlled by the control unit 303 of the controller 300. Specifically, in the normal operation, the control unit 303 opens the on-off valve 213 and closes the on-off valve 214. In this state, all of the refrigerating machine oil separated by the oil separator 105 returns to the compressor 100 without flowing into the injection pipe 230. By contrast, in the low load operation, the control unit 303 opens the on-off valve 214. As a result, part of the refrigerating machine oil separated by the oil separator 105 flows into the injection pipe 230 through the oil return pipe 210 and the oil branch pipe 211. It should be noted that in the low load operation, the control unit 303 may adjust the duration of closing and opening of the on-off valve 213 and the duration of closing and opening of the on-off valve 214 to adjust the ratio of the refrigerating machine oil that flows into the injection pipe 230 to the refrigerating machine oil that does not flow into the injection pipe 230. For example, the ratio of the refrigerating machine oil that flows into the injection pipe 230 may be increased as the thermal load decreases.

As described above, in the low load operation, liquid refrigerant more easily flows from the injection pipe 230 into the compressor 100 than in the normal operation. Therefore, in the case where the compressor 100 is configured as illustrated in FIG. 2, as described above, the refrigerating machine oil stored in the oil sump 34 may be diluted with the liquid refrigerant. If the refrigerating machine oil stored in the oil sump 34 is excessively diluted with the liquid refrigerant, lubrication of the slide portion of the compressor 100 may be insufficient, and as a result, the reliability of the compressor 100 may be reduced. However, since the refrigeration cycle apparatus 200 according to Embodiment 2 is configured as described above, at least part of liquid refrigerant that flows through the injection pipe 230 joins in the injection pipe 230, refrigerating machine oil whose temperature is higher than the refrigerant, and then evaporates. Therefore, it is possible to reduce the inflow of the liquid refrigerant from the injection pipe 230 into the compressor 100 during the low load operation. Accordingly, since the refrigeration cycle apparatus 200 according to Embodiment 2 has the above configuration, the reliability of the compressor 100 can be improved.

Furthermore, in the low load operation, it is harder to supply refrigerating machine oil to the slide portion of the compressor 100 than in the normal operation, and lubrication of the slide portion easily becomes insufficient than in the normal operation. However, in the refrigeration cycle apparatus 200 according to Embodiment 2, using the compressor 100 as illustrated in FIG. 4 or 5, it is possible to directly supply refrigerating machine oil to the suction chamber 7*c*. Therefore, in the refrigeration cycle apparatus 200 according to Embodiment 2, using the compressor 100 as illustrated in FIG. 4 or 5, it is easier to supply refrigerating machine oil to the slide portion of the compression mechanism unit 8, and it is also possible to reduce leakage of refrigerant from a space between the first scroll lap 2*b* of the fixed scroll 2 and the second scroll lap 1*b* of the orbiting scroll 1. Accordingly, in the refrigeration cycle apparatus 200 according to Embodiment 2, because of use of the compressor 100 as illustrated in FIG. 4 or 5, the reliability of the compressor 100 is improved, and the efficiency of the compressor 100 is also improved.

Embodiment 3

As described below, a bypass pipe 240, a third expansion valve 241, and a heat exchanger 242 may be added to the refrigeration cycle apparatus 200 according to Embodiment 1 or 2. As described above, also, in the normal operation, refrigerant may be supplied from the injection pipe 230 to the compressor 100. Because of the addition of the bypass pipe 240, the third expansion valve 241, and the heat exchanger 242, it is possible to reduce deterioration of the capacity of the refrigeration cycle apparatus 200 that occurs in the case of supplying refrigerant from the injection pipe 230 to the compressor 100 during the normal operation. It should be noted that regarding Embodiment 3, mattes that will not particularly be described are similar to those of Embodiment 1 or 2, and functions and components that are similar to those of Embodiment 1 or 2 will be described with reference to the same reference signs. The following description is made by referring to by way of example the case wherein the bypass pipe 240, the third expansion valve 241, and the heat exchanger 242 are added to the refrigeration cycle apparatus 200 according to Embodiment 2.

Figure 7:
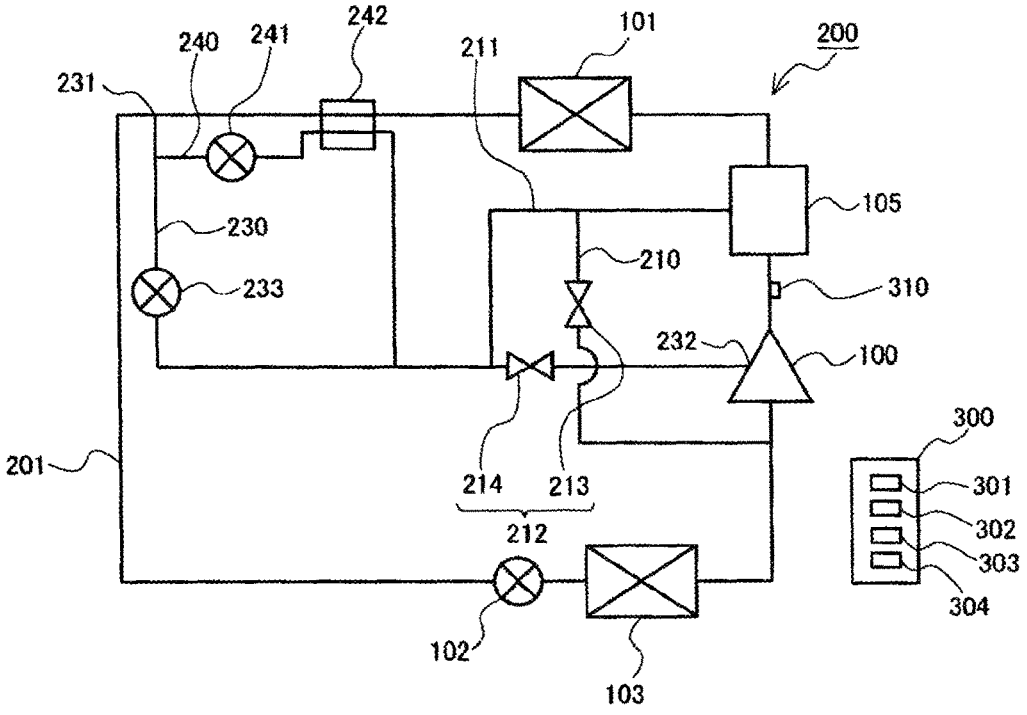
FIG. 7 is a refrigerant circuit diagram of a refrigeration cycle apparatus according to Embodiment 3 of the present disclosure.

FIG. 7 is a refrigerant circuit diagram of a refrigeration cycle apparatus according to Embodiment 3 of the present disclosure.

The refrigeration cycle apparatus 200 according to Embodiment 3 includes the bypass pipe 240, the third expansion valve 241, and the heat exchanger 242 in addition to the components of the refrigeration cycle apparatus 200 according to Embodiment 2. One end of the bypass pipe 240 is connected to part of the injection pipe 230 that is located upstream of the second expansion valve 233. The other end of the bypass pipe 240 is connected to part of the injection pipe 230 that is located downstream of the second expansion valve 233. The third expansion valve 241 is provided at the bypass pipe 240. The opening degree of the third expansion valve 241 is controlled by the control unit 303 of the controller 300. The heat exchanger 242 causes heat exchange to be performed between refrigerant that flows between the condenser 101 and the first expansion valve 102 and refrigerant that flows through part of the bypass pipe 240 that is located downstream of the third expansion valve. That is, the third expansion valve 241 is a heat exchanger that cools refrigerant that has flowed out of the condenser 101, with refrigerant that has been expanded by the expansion valve 241 after having flowed out of the condenser 101.

In Embodiment 3, in the case where refrigerant is supplied from the injection pipe 230 to the suction side of the compressor 100 in a state in which the low load operation is not performed, the control unit 303 of the controller 300 closes the second expansion valve 233 and opens the third expansion valve 241. In other words, in the case where refrigerant is supplied from the injection pipe 230 to the suction side of the compressor 100 in the normal operation, the control unit 303 closes the second expansion valve 233 and opens the third expansion valve 241. As a result, part of the high-pressure liquid refrigerant that has flowed out of the condenser 101 flows into the injection pipe 230 and flows into the bypass pipe 240. Then, the high-pressure liquid that has flowed into the bypass pipe 240 is expanded at the third expansion valve 241 and drops in temperature. This refrigerant that has dropped in temperature flows into the heat exchanger 242 and cools the high-pressure liquid refrigerant that has flowed out of the condenser 101.

When refrigerant is supplied from the injection pipe 230 to the suction side of the compressor 100, the flow rate of refrigerant that flows through the evaporator 103 decreases. However, in the normal operation, the high-pressure liquid refrigerant that has flowed out of the condenser 101 is cooled in the above manner, whereby the degree of subcooling of the high-pressure liquid refrigerant that has flowed out of the condenser 101 is increased, and the amount of heat that is absorbed at the evaporator 103 can thus be increased. Therefore, in the normal operation, since the high-pressure liquid refrigerant that has flowed out of the condenser 101 is cooled in the heat exchanger 242 in the above manner, it is possible to reduce deterioration of the capacity of the refrigeration cycle apparatus 200 that occurs in the case of supplying refrigerant from the injection pipe 230 to the suction side of the compressor 100.

By contrast, in the low load operation, the control unit 303 opens the second expansion valve 233 and closes the third expansion valve 241 to supply refrigerant from the injection pipe 230 to the suction side of the compressor 100. Therefore, in the low load operation, in the case where refrigerant is supplied from the injection pipe 230 to the suction side of the compressor 100, refrigerant that has been expanded by the third expansion valve 241 and has dropped in temperature does not flow to the heat exchanger 242. That is, during the low load operation, refrigerant is supplied from the injection pipe 230 to the suction side of the compressor 100, as in Embodiment 2. Thus, the degree of subcooling of the high-pressure liquid refrigerant that has flowed out of the condenser 101 does not increase, and in the case of supplying refrigerant from the injection pipe 230 to the suction side of the compressor 100 during the low load operation, the capacity of the refrigeration cycle apparatus 200 does not increase.

Since the refrigeration cycle apparatus 200 according to Embodiment 3 is configured as described above, in the low load operation, it is possible to supply refrigerant from the injection pipe 230 to the suction side of the compressor 100 as in Embodiments 1 and 2. Therefore, because of the above configuration of the refrigeration cycle apparatus 200 according to Embodiment 3, as in Embodiments 1 and 2, it is possible to further reduce repetition of stopping and starting of the compressor 100 than in the existing refrigeration cycle apparatus. In addition, because of the configuration of the refrigeration cycle apparatus 200 according to Embodiment 3, as compared with Embodiments 1 and 2, it is possible to further reduce deterioration of capacity of the refrigeration cycle apparatus 200 that occurs in the case of supplying refrigerant from the injection pipe 230 to the suction side of the compressor 100 during the normal operation.

Embodiment 4

In the case where the refrigeration cycle apparatus 200 employs a compressor 100 configured to cause refrigerant to flow from the injection pipe 230 directly into the suction chamber 7*c*, refrigerant is caused to flow from the injection pipe 230 directly into the suction chamber 7*c* as in Embodiment 4, whereby the duration of continuous operation of the refrigeration cycle apparatus 200 can be extended. It should be noted that regarding Embodiment 4, matters that will not particularly be described are similar to those of any of Embodiments 1 to 3, and functions and components that are similar to those of any of Embodiments 1 to 3 will be described with reference to the same reference signs. The following description is made by referring to by way of example the case where the refrigeration cycle apparatus 200 according to Embodiment 3 is modified.

Figure 8:
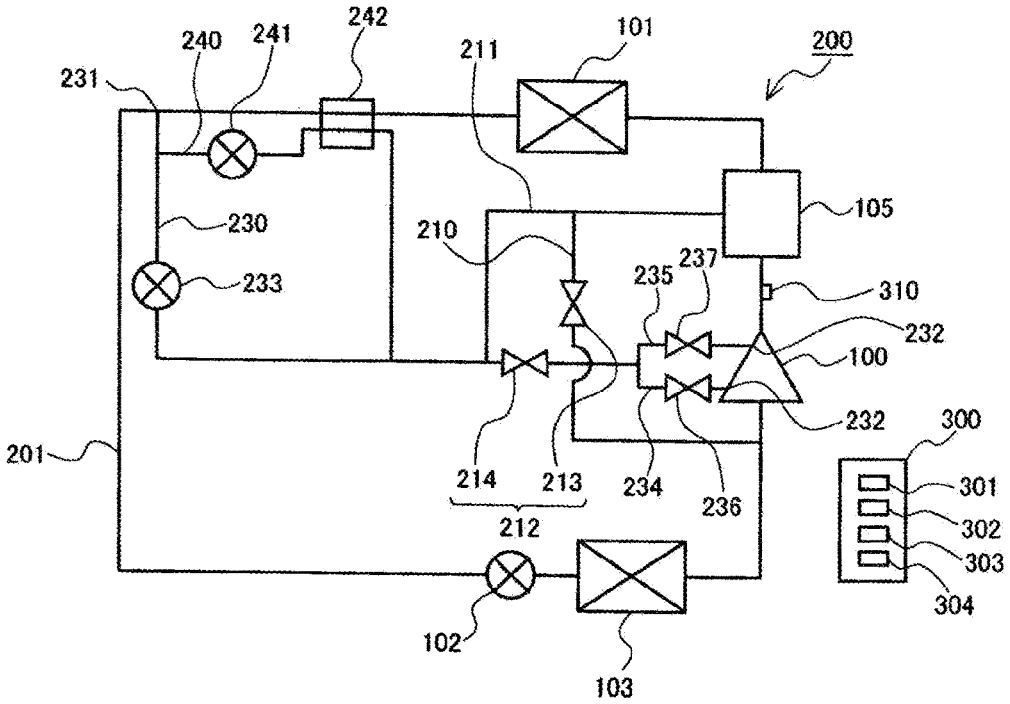
FIG. 8 is a refrigerant circuit diagram of a refrigeration cycle apparatus according to Embodiment 4 of the present disclosure.

FIG. 8 is a refrigerant circuit diagram of a refrigeration cycle apparatus according to Embodiment 4 of the present disclosure.

In the refrigeration cycle apparatus 200 according to Embodiment 4, the injection pipe 230 includes a first outflow pipe 234 and a second outflow pipe 235 that are included in respective refrigerant outflow side ends 232. In other words, the refrigerant outflow side ends 232 of the injection pipe 230 are branch ends connected to the first outflow pipe 234 and the second outflow pipe 235. Furthermore, the injection pipe 230 includes a first on-off valve 236 and a second on-off valve 237. The first on-off valve 236 is provided at the first outflow pipe 234, and opens and closes a flow passage of the first outflow pipe 234. The second on-off valve 237 is provided at the second outflow pipe 235, and opens and closes a flow passage of the second outflow pipe 235. The first on-off valve 236 and the second on-off valve 237 may be on-off valves that can be simply opened and closed or may be on-off valves whose opening degrees are adjustable.

Figure 9:
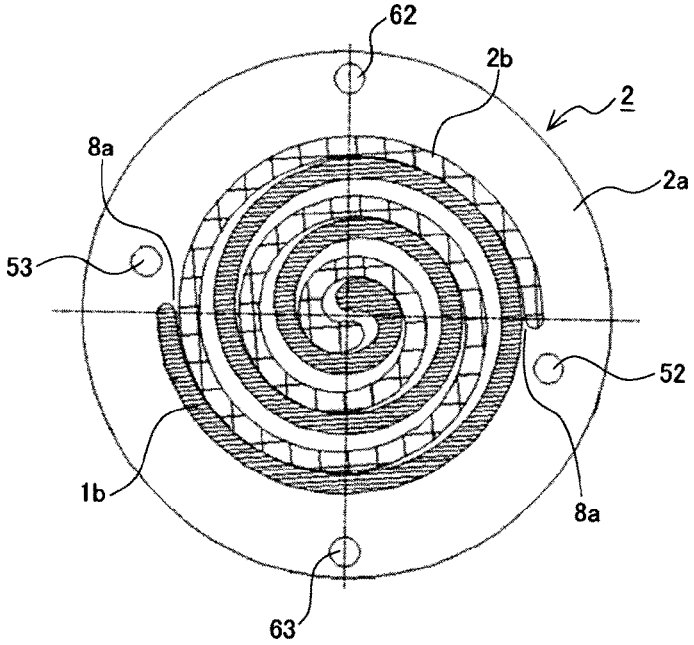
FIG. 9 is a bottom view illustrating a fixed scroll of a compressor of the refrigeration cycle apparatus according to Embodiment 4 of the present disclosure.
Figure 10:
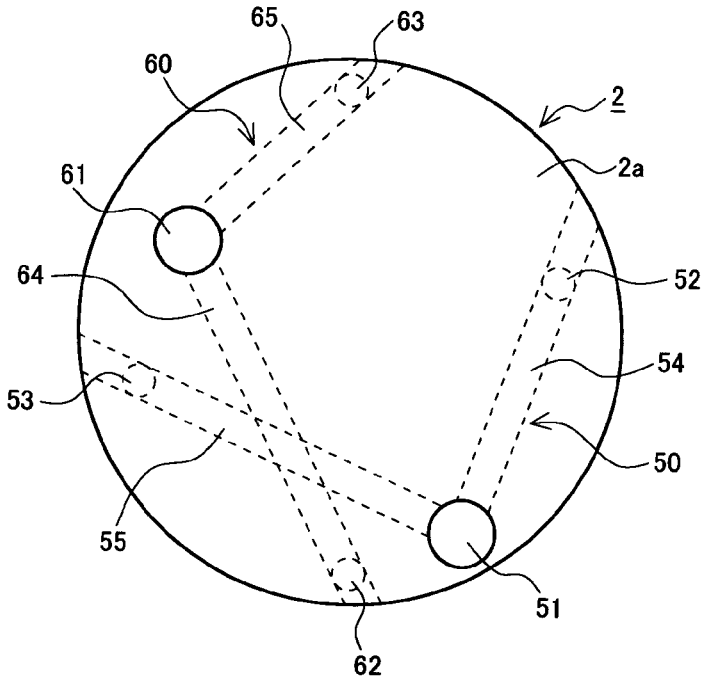
FIG. 10 is a plan view illustrating the fixed scroll of the compressor of the refrigeration cycle apparatus according to Embodiment 4 of the present disclosure.
Figure 11:
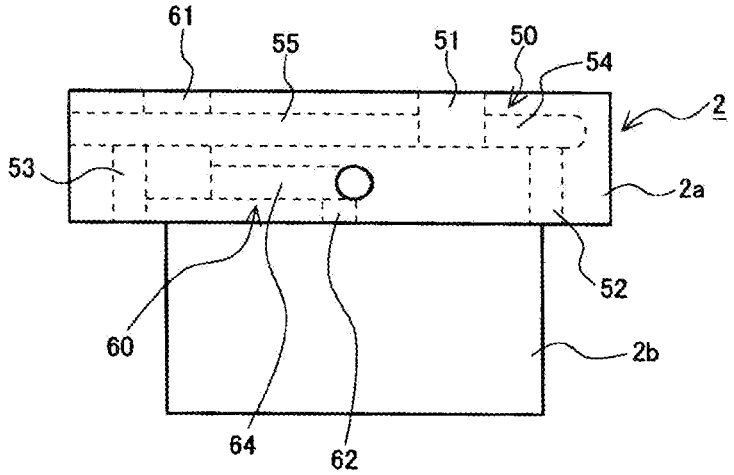
FIG. 11 is a side view illustrating the fixed scroll of the compressor of the refrigeration cycle apparatus according to Embodiment 4 of the present disclosure.

When refrigerant flows from the first outflow pipe 234 and the second outflow pipe 235 into the hermetic vessel 30, refrigerant flowing through the first outflow pipe 234 and the second outflow pipe 235 flows into the suction chamber 7*c* without passing through the lower space below the frame 7. In this case, the distance between a refrigerant inflow port through which refrigerant that has flowed through the second outflow pipe 235 flows into the suction chamber 7*c* and the refrigerant suction port of the compression mechanism unit 8 is longer than the distance between a refrigerant inflow port through which refrigerant that has flowed through the first outflow pipe 234 flows into the suction chamber 7*c* and the refrigerant suction port of the compression mechanism unit 8. Such a configuration can be achieved by configuring the compressor 100 as illustrated in FIGS. 9 to 11, for example. It should be noted that the refrigerant suction port of the compression mechanism unit 8 is the space between the outer peripheral edge of the second scroll lap 1*b* of the orbiting scroll 1 and the first scroll lap 2*b* of the fixed scroll 2. Furthermore, the refrigerant suction port of the compression mechanism unit 8 is the space between the second scroll lap 1*b* of the orbiting scroll 1 and the outer peripheral edge of the first scroll lap 2*b* of the fixed scroll 2. Referring to FIG. 9, the refrigerant suction port of the compression mechanism unit 8 is illustrated as a suction port 8*a*.

FIG. 9 is a bottom view illustrating a fixed scroll of a compressor of the refrigeration cycle apparatus according to Embodiment 4 of the present disclosure. FIG. 10 is a plan view illustrating the fixed scroll of the compressor of the refrigeration cycle apparatus according to Embodiment 4 of the present disclosure. FIG. 11 is a side view illustrating the fixed scroll of the compressor of the refrigeration cycle apparatus according to Embodiment 4 of the present disclosure. It should be noted that FIG. 9 also illustrates the second scroll lap 1*b* of the orbiting scroll 1.

In the fixed scroll 2 of the compressor 100 according to Embodiment 4, a communication flow passage 50 and a communication flow passage 60 are both provided in the base plate 2*a*. The communication flow passage 50 is made up of a hole 51, a first inflow port 52, a first inflow port 53, a communicating hole 54, and a communicating hole 55. The hole 51 is a hole that is open upward, and the first outflow pipe 234 is connected to the hole 51. The first inflow port 52 is a hole that is open to communicate with the suction chamber 7*c*, and also communicates with the hole 51 via the communicating hole 54. The first inflow port 53 is a hole that is open to communicate with the suction chamber 7*c*, and also communicates with the hole 51 via the communicating hole 55. The communication flow passage 60 is made up of a hole 61, a second inflow port 62, a second inflow port 63, a communicating hole 64, and a communicating hole 65. The hole 61 is a hole that is open upward, and the second outflow pipe 235 is connected to the hole 61. The second inflow port 62 is a hole that is open to communicate with the suction chamber 7*c*, and also communicates with the hole 61 via the communicating hole 64. The second inflow port 63 is a hole that is open to communicate with the suction chamber 7*c*, and also communicates with the hole 61 via the communicating hole 65.

The communication flow passage 50 and the communication flow passage 60 do not communicate with each other. Specifically, as illustrated in FIG. 10, the communicating hole 55 of the communication flow passage 50 and the communicating hole 64 of the communication flow passage 60 overlap each other as viewed in plan view. However, as illustrated in FIG. 11, the communicating hole 55 of the communication flow passage 50 and the communicating hole 64 of the communication flow passage 60 are located at different levels, whereby the communication flow passage 50 and the communication flow passage 60 do not communicate with each other. Therefore, refrigerant that has flowed from the first outflow pipe 234 into the communication flow passage 50 flows into the suction chamber 7*c* only through the first inflow port 52 and the first inflow port 53. Furthermore, refrigerant that has flowed from the second outflow pipe 235 into the communication flow passage 60 flows into the suction chamber 7*c* only through the second inflow port 62 and the second inflow port 63.

That is, the first inflow port 52 and the first inflow port 53 serve as refrigerant inflow ports through which refrigerant that has flowed through the first outflow pipe 234 flows into the suction chamber 7*c*. Furthermore, the second inflow port 62 and the second inflow port 63 serve as refrigerant inflow ports through which refrigerant that has flowed through the second outflow pipe 235 flows into the suction chamber 7*c*. As illustrated in FIG. 9, the distance between each of the second inflow ports 62 and 63 and the refrigerant suction port 8*a* of the compression mechanism unit 8 is longer than the distance between each of the first inflow ports 52 and 53 and the refrigerant suction port 8*a* of the compression mechanism unit 8.

During the low load operation, the control unit 303 of the controller 300 controls the first on-off valve 236 and the second on-off valve 237 in the following manner. When a temperature detected by the temperature sensor 310 provided at the refrigerant pipe that connects the compressor 100 and the condenser 101 is higher than a specified temperature, the control unit 303 closes the second on-off valve 237 and opens the first on-off valve 236. As a result, the refrigerant that has passed through the injection pipe 230 and has been expanded at the second expansion valve 233 passes through the first outflow pipe 234 and the communication flow passage 50 and flow into the suction chamber 7*c* through the first inflow port 52 and the first inflow port 53. By contrast, when the temperature detected by the temperature sensor 310 drops to the specified temperature, the control unit 303 closes the first on-off valve 236 and opens the second on-off valve 237. As a result, the refrigerant that has passed through the injection pipe 230 and has been expanded at the second expansion valve 233 passes through the second outflow pipe 235 and the communication flow passage 60 and flows into the suction chamber 7*c* through the second inflow port 62 and the second inflow port 63. It should be noted that the specified temperature is a temperature that is lower than the above upper limit temperature and higher than the above lower limit temperature.

The gas refrigerant that has flowed out of the evaporator 103 also flows into the suction chamber 7*c*. Then, the gas refrigerant that has flowed out of the evaporator 103 passes through the injection pipe 230 and has a higher temperature than the refrigerant that has passed through the injection pipe 230 and has been expanded at the second expansion valve 233. Therefore, the refrigerating that has flowed from the injection pipe 230 into the suction chamber 7*c* is sucked into the compression mechanism unit 8 after being heated by the gas refrigerant that has flowed out of the evaporator 103.

As described above, in order to reduce compression of liquid by the compressor 100, the control unit 303 stops the compressor 100 when the temperature detected by the temperature sensor 310 drops to the lower limit temperature. In Embodiment 4, when the temperature detected by the temperature sensor 310 drops to the specified temperature, the refrigerant flowing through the injection pipe 230 flows into the suction chamber 7*c* through the second inflow port 62 and the second inflow port 63. Furthermore, the distance between each of the second inflow ports 62 and 63 and the refrigerant suction port 8*a* of the compression mechanism unit 8 is longer than the distance between each of the first inflow ports 52 and 53 and the refrigerant suction port 8*a* of the compression mechanism unit 8. Thus, the refrigerant that has flowed into the suction chamber 7*c* through the second inflow port 62 and the second inflow port 63 is sucked into the compressor mechanism unit 8 after being heated by the gas refrigerant that has flowed out of the evaporator 103 for a longer time than the refrigerant that has flowed into the suction chamber 7*c* through the first inflow port 52 and the first inflow port 53. Therefore, the temperature of the refrigerant discharged from the compressor 100 does not easily drop to the lower limit temperature. Accordingly, because of provision of the configuration of the refrigeration cycle apparatus according to Embodiment 4, it is possible to further reduce the frequency of stopping of the compressor 100, and extend the duration of continuous operation of the refrigeration cycle apparatus 200.

Regarding Embodiments 1 to 4, it is described above that each of the refrigeration cycle apparatuses according to Embodiments 1 to 4 of the present disclosure is used as an air-conditioning apparatus, but each of the refrigeration cycle apparatuses according to Embodiments 1 to 4 is not limited to the air-conditioning apparatus. For example, the refrigeration cycle apparatuses according to Embodiments 1 to 4 can be used as various apparatuses provided with a refrigeration cycle circuit, such as a refrigerator, a cooling apparatus that cools the interior of a freezer, and a water heating apparatus that heats water.

REFERENCE SIGNS LIST

1 orbiting scroll 1*a* base plate 1*b* second scroll lap 1*c* orbiting bearing 1*d* boss 2 fixed scroll 2*a* base plate 2*b* first scroll lap 2*c* discharge port 2*d* discharge valve 2*e* valve guard 2*f* communication flow passage 2*g* horizontal hole 2*h* vertical hole 3 compression chamber 4 Oldham's ring 5 slider 6 driving shaft 6*a* eccentric shaft portion 6*b* main shaft portion 6*c* sub shaft portion 7 frame 7*a* main bearing 7*b* through-hole 7*c* suction chamber 7*d* thrust surface 7*e* through-hole 8 compression mechanism unit 8*a* suction port 9 sub-frame 10 sub shaft bearing 13 sleeve 20 electric motor 21 stator 22 rotor 22*b* balance weight 30 hermetic vessel 31 tubular member 31*a* through-hole 32 upper lid member 32*a* through-hole 33 lower lid member 34 oil sump 41 suction tube 41*a* injection tube 41*b* attachment 42 discharge tube 50 communication flow passage 51 hole 52 first inflow port 53 first inflow port 54 communicating hole 55 communicating hole 60 communication flow passage 61 hole 62 second inflow port 63 second inflow port 64 communicating hole 65 communicating hole 100 compressor 101 condenser 102 first expansion valve 103 evaporator 105 oil separator 200 refrigeration cycle apparatus 201 refrigeration cycle circuit 210 oil return pipe 211 oil branch pipe 212 oil distribution device 213 on-off valve 214 on-off valve 230 injection pipe 231 refrigerant inflow side end 232 refrigerant outflow side end 233 second expansion valve 234 first outflow pipe 235 second outflow pipe 236 first on-off valve 237 second on-off valve 240 bypass pipe 241 third expansion valve 242 heat exchanger 300 controller 301 reception unit 302 thermal-load acquisition unit 303 control unit 304 storage unit 310 temperature sensor

The invention claimed is:

1. A refrigeration cycle apparatus comprising:

a refrigeration cycle circuit in which a compressor, a condenser, a first expansion valve, and an evaporator are connected by refrigerant pipes;

an injection pipe having a refrigerant inflow side end and a refrigerant outflow side end, the refrigerant inflow side end being connected between the condenser and the first expansion valve, the refrigerant outflow side end being connected to a suction side of the compressor;

a second expansion valve provided at the injection pipe; and a controller configured to control a rotation speed of the compressor and an opening degree of the second expansion valve, wherein the controller is configured to determine whether the rotation speed of the compressor is at or below a specified low load rotation speed, in response to the rotation speed of the compressor being determined to be at or below the specified low load rotation speed, perform a low load operation during which the rotation speed is maintained at the specified low load rotation speed and the controller controls the second expansion valve to open to cause refrigerant to flow through the injection pipe to the suction side of the compressor, to reduce a heat-exchange capability of the evaporator.

2. The refrigeration cycle apparatus of claim 1, wherein the compressor includes a compression mechanism unit having an orbiting scroll and a fixed scroll, a frame configured to support the orbiting scroll from below, and a hermetic vessel that houses the compression mechanism unit and the frame and stores refrigerating machine oil at a bottom portion of the hermetic vessel, the fixed scroll has a first scroll lap, the orbiting scroll has a second scroll lap that is combined with the first scroll lap to form a compression chamber together with the first scroll lap, the compression mechanism unit is configured to suck refrigerant from a suction chamber into the compression chamber, the suction chamber being formed on outer peripheral sides of the first scroll lap and the second scroll lap, and when refrigerant flows from the injection pipe into the hermetic vessel, refrigerant flowing through the injection pipe flows into the suction chamber.

3. The refrigeration cycle apparatus of claim 2, wherein the compressor includes an injection tube that is connected to the injection pipe, the hermetic vessel includes a tubular member to which the frame is fixed, and the injection tube is fixed to the tubular member and communicates with the suction chamber.

4. The refrigeration cycle apparatus of claim 2, wherein the compressor includes an injection tube that is connected to the injection pipe, the hermetic vessel includes a tubular member to which the frame is fixed and an upper lid member that covers an upper opening portion of the tubular member, in the fixed scroll, a communication flow passage is provided in such a manner as to communicate with the suction chamber, and the injection tube is fixed to the upper lid member and communicates with the communication flow passage.

5. The refrigeration cycle apparatus of claim 2, further comprising a temperature sensor configured to detect a temperature of a refrigerant pipe that connects the compressor and the condenser, wherein the injection pipe includes a first outflow pipe and a second outflow pipe that are included in the refrigerant outflow side end, a first on-off valve configured to open and close a flow passage of the first outflow pipe, and a second on-off valve configured to open and close a flow passage of the second outflow pipe, where an inflow port through which refrigerant that has flowed through the first outflow pipe flows into the suction chamber is a first inflow port, and an inflow port through which refrigerant that has flowed through the second outflow pipe flows into the suction chamber is a second inflow port, a distance between the second inflow port and a refrigerant suction port of the compression mechanism unit is longer than a distance between the first inflow port and the refrigerant suction port of the compression mechanism unit, and the controller is configured to:

close the second on-off valve and open the first on-off valve, when during a low load operation, the temperature detected by the temperature sensor is higher than a specified temperature; and close the first on-off valve and open the second on-off valve, when the temperature detected by the temperature sensor drops to the specified temperature.

6. The refrigeration cycle apparatus of claim 1, further comprising:

an oil separator provided between the compressor and the condenser and configured to separate refrigerating machine oil from refrigerant discharged from the compressor;

an oil return pipe that has one end connected to the oil separator and an other end connected to the suction side of the compressor, the oil return pipe being configured to return the refrigerating machine oil separated by the oil separator to the suction side of the compressor; and an oil branch pipe that has one end connected to the oil return pipe and an other end connected to part of the injection pipe that is located downstream of the second expansion valve, wherein during the low load operation, the refrigerating machine oil flows into the injection pipe through the oil return pipe and the oil branch pipe.

7. The refrigeration cycle apparatus of claim 1, further comprising:

a bypass pipe that has one end connected to part of the injection pipe that is located upstream of the second expansion valve and an other end connected to part of the injection pipe that is located downstream of the second expansion valve;

a third expansion valve provided at the bypass pipe; and a heat exchanger configured to cause heat exchange to be performed between refrigerant that flows between the condenser and the first expansion valve and refrigerant that flows through part of the bypass pipe that is located downstream of the third expansion valve.

8. The refrigeration cycle apparatus of claim 7, wherein the controller is configured to close the second expansion valve and open the third expansion valve to cause refrigerant to flow through the bypass pipe and the heat exchanger, in a case of supplying refrigerant from the injection pipe to the suction side of the compressor in a state in which the low load operation is not performed, and the controller is configured to, in the low load operation, open the second expansion valve and close the third expansion valve to supply refrigerant from the injection pipe to the suction side of the compressor.

* * * * *